US009511595B2

(12) United States Patent
Nagashima

(10) Patent No.: US 9,511,595 B2
(45) Date of Patent: Dec. 6, 2016

(54) LIQUID CONTAINER AND LIQUID SUPPLY APPARATUS

(71) Applicant: SEIKO EPSON CORPORATION, Tokyo (JP)

(72) Inventor: Takumi Nagashima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/873,603

(22) Filed: Oct. 2, 2015

(65) Prior Publication Data

US 2016/0096373 A1 Apr. 7, 2016

(30) Foreign Application Priority Data

Oct. 6, 2014 (JP) ..... 2014-205494

(51) Int. Cl.
*B41J 2/175* (2006.01)

(52) U.S. Cl.
CPC ..... *B41J 2/1752* (2013.01); *B41J 2/17509* (2013.01); *B41J 2/17513* (2013.01); *B41J 2/17523* (2013.01); *B41J 2/17596* (2013.01); *B41J 2002/17516* (2013.01)

(58) Field of Classification Search
CPC ..... B08B 3/026; B08B 3/028; B26B 21/52; B26B 21/4012; B41J 2/17503; B41J 2/17506; B41J 2/17509; B41J 2/1752; B41J 2/17513; B41J 2/17523; B41J 2/17533; B41J 2/17553; B41J 2/17559; B41J 2/17596
USPC ..... 347/86; 220/770, 771, 775
See application file for complete search history.

(56) References Cited

U.S. PATENT DOCUMENTS 4,804,119 A * 2/1989 Goodall ..... B65D 1/12 215/383
4,848,602 A * 7/1989 Yoshimura ..... B41J 2/175 141/286
6,196,425 B1 * 3/2001 Fielding ..... B65D 25/42 222/468
6,237,792 B1 * 5/2001 Skolnicki ..... B65D 23/10 215/365
6,375,315 B1 * 4/2002 Steinmetz ..... B41J 2/17503 347/85
7,726,503 B2 * 6/2010 Dygert ..... B65D 1/20 215/398

FOREIGN PATENT DOCUMENTS

JP 2009-202346 A 9/2009

* cited by examiner

*Primary Examiner* — Anh T. N. Vo
(74) *Attorney, Agent, or Firm* — Global IP Counselors, LLP

(57) ABSTRACT

An ink container that is attachable to and detachable from a liquid supply apparatus that supplies ink to a liquid injection apparatus. The ink container includes: an ink container part that houses ink; a handle unit that is located at an end of the ink container part; and an ink outlet part that is provided on the handle unit and that is in communication with an inside of the ink container part via the handle unit. The ink outlet part is located on a portion of the handle unit that is on an opposite side to the ink container part side.

10 Claims, 17 Drawing Sheets

LIQUID CONTAINER AND LIQUID SUPPLY APPARATUS

BACKGROUND

1. Technical Field

The present invention relates to a liquid container, a liquid supply apparatus, and so on.

2. Related Art

Inkjet printers are known as an example of liquid injection apparatuses. Typically, inkjet printers can perform printing on recording media such as paper by injecting ink from a recording head onto the recording media. Regarding this kind of printer, a configuration is known to which an external ink supply apparatus (liquid supply apparatus) is connected in order to stably supply ink to the recording head (see JP-A-2009-202346, for example).

The external ink supply apparatus disclosed in JP-A-2009-202346 has an ink supply tube (an example of a liquid inlet part) connected to a connection part (an example of a liquid outlet part) of an ink bag. Ink inside the ink bag is supplied to the printer from the connection part via the ink supply tube. In the above-described external ink supply apparatus, the connection part to which the ink supply tube is connected is located on the lower side of the ink bag in the vertical direction. The connection part of the ink bag is thus difficult to see when replacing the ink bag, for example. Thus, there is a problem with known liquid containers and liquid supply apparatuses in that it is difficult to attach and detach the liquid inlet part to and from the liquid outlet part.

SUMMARY

The invention can solve at least the above-described problem, and may be realized as the following embodiments or application examples.

APPLICATION EXAMPLE 1

A liquid container that is attachable to and detachable from a liquid supply apparatus that supplies a liquid to a liquid injection apparatus. The liquid container includes: a liquid container part that houses the liquid; a handle part that is located at an end of the liquid container part; and a liquid outlet part that is provided on the handle part and that is in communication with an inside of the liquid container part via the handle part. The liquid outlet part is located on a portion of the handle part that is on an opposite side to the liquid container part side.

In the liquid container according to this application example, the liquid outlet part is located on a portion of the handle part that is on the opposite side to the liquid container part side. Therefore, when the operator grips the handle part such that the liquid container hangs, the liquid outlet part is located on the upper side of the liquid container. Accordingly, the liquid outlet part is easy to see.

APPLICATION EXAMPLE 2

The liquid container according to the above, wherein the handle part includes: a base part that is located at an end of the liquid container part and projects further outside than the liquid container part; a gripping part that is located further on the opposite side to the liquid container part side than the base part; and a leg part that connects the base part and the gripping part, and the liquid outlet part is provided on the gripping part.

According to this application example, when the operator grips the gripping part such that the liquid container hangs, the gripping part is located on the upper side of the liquid container. The liquid outlet part is provided on the gripping part. Therefore, when the operator grips the gripping part such that the liquid container hangs, the liquid outlet part is located on the upper side of the liquid container. Accordingly, the liquid outlet part is easy to see.

APPLICATION EXAMPLE 3

The liquid container according to the above, wherein at least part of a flow channel that extends from the liquid container part and that is in communication with the liquid outlet part is provided in the leg part.

According to this application example, at least part of the flow channel that extends from the liquid container part and that is in communication with the liquid outlet part is provided in the leg part, and accordingly the amount of the liquid that can be housed in the liquid container can be increased.

APPLICATION EXAMPLE 4

The liquid container according to the above, further including a flow channel member that constitutes at least part of the flow channel. At least part of the flow channel member is housed in the leg part.

According to this application example, at least part of the flow channel that extends from the liquid container part and that is in communication with the liquid outlet part can be constituted by the flow channel member that is housed in the leg part.

APPLICATION EXAMPLE 5

A liquid container that is attachable to and detachable from a liquid supply apparatus that supplies a liquid to a liquid injection apparatus, the liquid container including: a liquid container part that houses the liquid; and a liquid outlet part that is in communication with an inside of the liquid container part. A handle part is formed at an end of the liquid container part, and the liquid outlet part is provided on the handle part.

In the liquid container according to this application example, the liquid outlet part is provided on the handle part that is formed at an end of the liquid container part. Therefore, when the operator grips the handle part such that the liquid container hangs, the liquid outlet part is located on the upper side of the liquid container. Accordingly, the liquid outlet part is easy to see.

APPLICATION EXAMPLE 6

The liquid container according to the above, wherein a liquid outlet port is formed in the liquid outlet part, and when the liquid container is supported by gripping the handle part, the liquid outlet port is orientated in a direction that intersects a direction of gravity.

According to this application example, when the operator grips the handle part such that the liquid container hangs, the liquid outlet port is orientated in a direction that intersects the direction of gravity. Therefore, it is easy to prevent a foreign object such as dust from attaching to the liquid outlet port.

APPLICATION EXAMPLE 7

The liquid container according to the above, further including an electrical contact part that is contactable with an electrical connection part provided in the liquid supply apparatus. The electrical contact part is provided on the handle part.

According to this application example, the electrical contact part is provided on the handle part. Therefore, when the operator grips the handle part such that the liquid container hangs, the electrical contact part is located on the upper side of the liquid container. Accordingly, the electrical contact part is easy to see.

APPLICATION EXAMPLE 8

A liquid supply apparatus to which a liquid container that houses a liquid is to be detachably attached, and that is capable of supplying the liquid housed in the liquid container to a liquid injection apparatus. The liquid container includes: a liquid container part that is capable of housing the liquid; a handle part that is located at an end of the liquid container part; and a liquid outlet part that is provided on the handle part and that is in communication with an inside of the liquid container part via the handle part. The liquid outlet part is located on a portion of the handle part that is on an opposite side to the liquid container part side. The liquid supply apparatus includes: a liquid inlet part to which the liquid inside the liquid container part is supplied from the liquid outlet part; and a movable supporting part that supports the handle part so as to be attachable and detachable. The handle part includes a first engaging part that is engageable with the movable supporting part. A first engaged part with which the first engaging part of the handle part engages is formed in the movable supporting part. In a state where the first engaging part of the handle part engages with the first engaged part, the movable supporting part can be displaced from a release position to a connected position, the release position being a position in which the liquid outlet part and the liquid inlet part are spaced apart from each other, and the connected position being a position in which the liquid outlet part and the liquid inlet part are connected to each other.

In the liquid supply apparatus according to this application example, in the liquid container, the liquid outlet part is located on a portion of the handle part that is on the opposite side to the liquid container part side. Therefore, when the operator grips the handle part such that the liquid container hangs, the liquid outlet part is located on the upper side of the liquid container. Accordingly, the liquid outlet part is easy to see, and the liquid outlet part is easy to attach to and detach from the liquid inlet part. Also, in this liquid supply apparatus, the liquid outlet part can be connected to the liquid inlet part by displacing the movable supporting part from the release position to the connected position, with the first engaging part of the handle part engaging with the first engaged part of the movable supporting part. Therefore, operations related to connecting the liquid outlet part and the liquid inlet part and releasing the connection can be easily performed, and the liquid outlet part can be even more easily attached to and detached from the liquid inlet part.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments will be described with reference to the drawings, taking a liquid injection system as an example. Note that the scale of constituent elements and members in the individual diagrams may differ, since the respective constituent elements are shown at a size that enables recognition.

Figure 1:
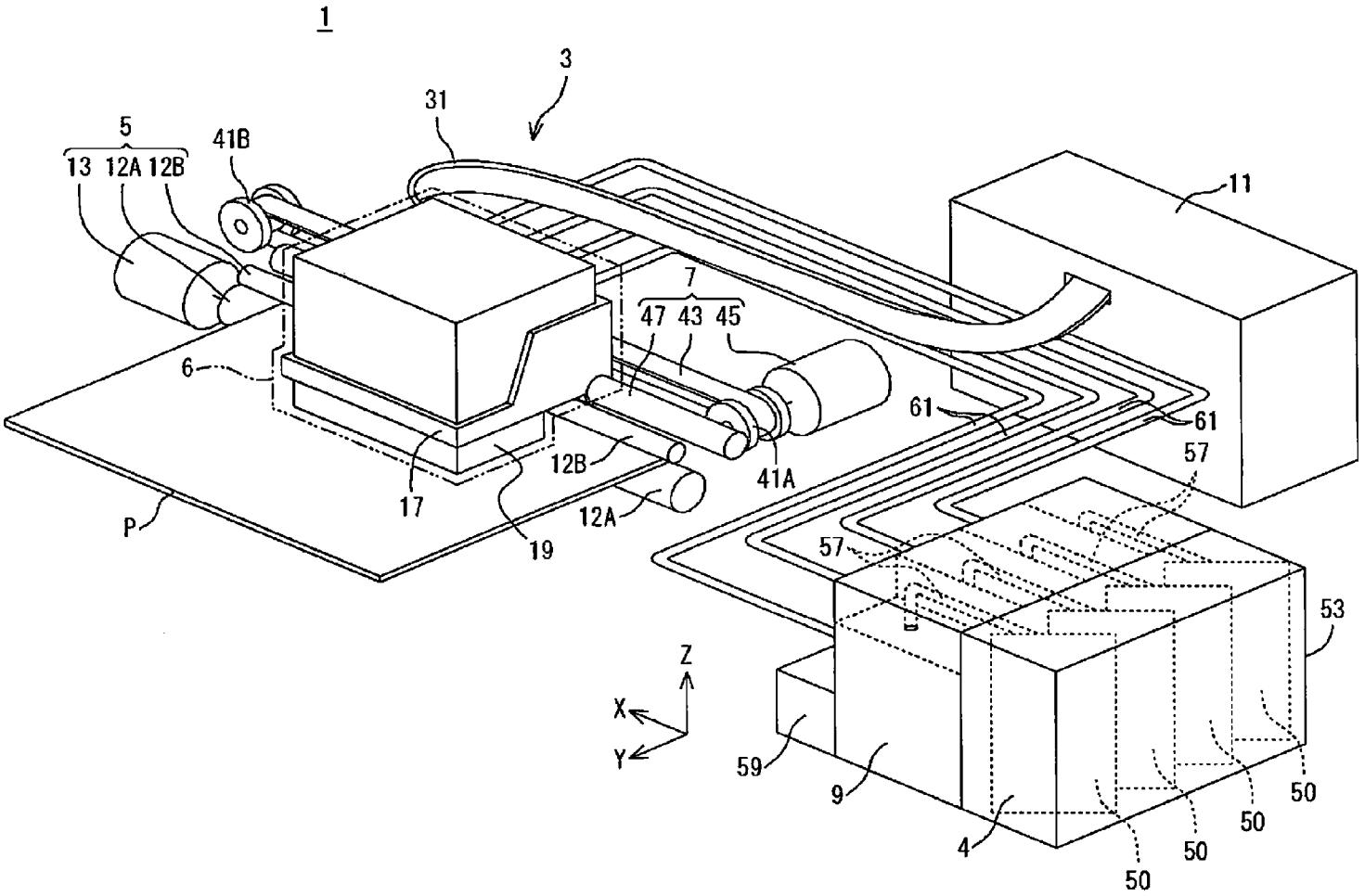
FIG. 1 is a perspective view showing a principal configuration of a liquid injection system according to an embodiment.

A liquid injection system 1 according to an embodiment includes, as shown in FIG. 1, a printer 3, which is an example of a liquid injection apparatus, and an ink supply apparatus 4, which is an example of a liquid supply apparatus. The printer 3 includes a conveyance apparatus 5, a recording part 6, a moving apparatus 7, a relay apparatus 9, and a control part 11. Note that FIG. 1 shows an X axis, a Y axis, and a Z axis, which are coordinate axes orthogonal to each other. The X axis, Y axis, and Z axis orthogonal to each other will also be given in diagrams shown below if necessary. In this embodiment, the usage state of the liquid injection system 1 is the state in which the liquid injection system 1 is disposed on the horizontal plane defined by the X axis and the Y axis (XY plane). The Z axis is an axis that is orthogonal to the horizontal plane. When the liquid injection system 1 is in the usage state, the Z axis direction coincides with the vertical upward direction. When the liquid injection system 1 is in the usage state, the −Z axis direction in FIG. 1 coincides with the vertical downward direction. Note that for each of the X, Y, and Z axes, the direction indicated by the arrow shows the + (positive) direction, and the direction opposite to the direction indicated by the arrow shows the − (negative) direction.

The conveyance apparatus 5 intermittently conveys recording media P such as recording paper in the Y axis direction. The recording part 6 records on the recording media P conveyed by the conveyance apparatus 3 with ink, which is an example of a liquid. The moving apparatus 7 moves the recording part 6 back and forth along the X axis. The ink supply apparatus 4 supplies ink to the recording part 6 via the relay apparatus 9. The relay apparatus 9 is provided between the ink supply apparatus 4 and the recording part 6, and relays the ink from the ink supply apparatus 4 to the recording part 6. The control part 11 controls the driving of each of the above-described constituent elements.

The conveyance apparatus 5, as shown in FIG. 1, includes a driving roller 12A, a driven roller 12B, and a conveyance motor 13. The driving roller 12A and the driven roller 12B are configured to be rotatable with their outer circumferences contacting each other. The conveyance motor produces power for rotationally driving the driving roller 12A. The power from the conveyance motor 13 is transmitted to the driving roller 12A via a transmission mechanism. The recording media P sandwiched between the driving roller 12A and the driven roller 12B are intermittently conveyed in the Y axis direction.

The recording part 6 includes a carriage 17 and a recording head 19. The recording head 19 is an example of a liquid injection part, and records on the recording media P by discharging ink as ink droplets. The carriage 17 is equipped with the recording head 19. Note that the recording head 19 is connected to the control part 11 via a flexible cable 31. The discharge of ink droplets from the recording head 19 is controlled by the control part 11.

The moving apparatus 7, as shown in FIG. 1, includes a timing belt 43, a carriage motor 45, and a guide shaft 47. The timing belt 43 is routed in a taut state around a pair of pulleys 41A and 41B. The pair of pulleys 41A and 41B are arranged along the X axis. Therefore, the timing belt 43 is routed in a taut state along the X axis. The carriage motor 45 produces power for rotationally driving the pulley 41A. The guide shaft 47 extends along the X axis. The guide shaft 47 is supported at both ends by a casing, which is not shown in the drawings, and guides the carriage 17 along the X axis.

The carriage 17 is fixed to a portion of the timing belt 43. Power is transmitted to the carriage 17 from the carriage motor 45 via the pulley 41A and the timing belt 43. Also, the carriage 17 is configured to be movable back and forth along the X axis with the transmitted power.

As shown in FIG. 1, an ink container 50, which is an example of a liquid container, is attached to the ink supply apparatus 4 so as to be detachable. The ink supply apparatus 4 also includes a casing 53, which is an example of a covering. Note that in the present embodiment, a plurality of (four in this embodiment) ink containers 50 can be attached to the ink supply apparatus 4. The four ink containers 50 are housed in the casing 53. Thus, the ink containers 50 can be covered with the casing 53. Therefore, the ink containers 50 can be protected with the casing 53, and, for example, it is easy to prevent dust or the like from attaching to the ink containers 50, and to prevent the ink containers 50 from being damaged.

Within the casing 53, an attachment/detachment unit (described later) is provided to support the ink containers 50. The four ink containers 50 are supported so as to be attachable to and detachable from the attachment/detachment unit. Each ink container 50 includes an ink container part, which is an example of a liquid container part. Ink is sealed by the ink container part, which is constituted by a flexible sheet. With the liquid injection system 1, the ink container is replaced with a new ink container 50 when the ink in the ink container part has been consumed.

An ink supply tube 57 is connected to the ink container part of each ink container 50 via the attachment/detachment unit (not shown in the drawing). The ink supply tube 57, which is an example of a flow channel member, is connected to the relay apparatus 9 from the ink supply apparatus 4. The relay apparatus 9 includes a pump unit 59, which is an example of a pump. The pump unit 59 pumps the ink inside the ink container part of the ink container 50 attached to the ink supply apparatus 4. The pump unit 59 then sends the ink pumped from the ink container part of the ink container 50 to the recording head 19 via the ink supply tube 61. The pump unit 59 can thereby aid in supplying ink from the ink supply apparatus 4 to the recording head 19. In this way, the ink inside the ink container part of the ink container 50 is supplied from the ink supply apparatus 4 to the recording head 19 via the relay apparatus 9. The ink supplied to the recording head 19 is then discharged as ink droplets from nozzles (not shown in the drawings) that face the recording media P side. Note that although the relay apparatus 9 and the ink supply apparatus 4 in the example above are described as individual constituent elements, the ink supply apparatus 4 may be configured to include the relay apparatus 9. Also, the printer 3 may be configured to include the relay apparatus 9.

With the liquid injection system 1 having the above configuration, the driving of the conveyance motor 13 is controlled by the control part 11, and the conveyance apparatus 5 intermittently conveys the recording media P in the Y axis direction while positioning the recording media P so as oppose the recording head 19. At this time, the control part 11 causes ink droplets to be discharged at predetermined positions by controlling the driving of the recording head 19, while moving the carriage 17 back and forth along the X axis by controlling the driving of the carriage motor 45. Such operations result in dots being formed on the recording media P, and recording being performed on the recording media P based on recording information such as image data.

Various embodiments of the ink container 50 will be described below. Note that in the following, in order to distinguish between the ink containers 50 of different embodiments, an alphabetic character that is different for each embodiment is attached to the reference sign of the corresponding ink container 50.

Embodiment 1

Figure 2:
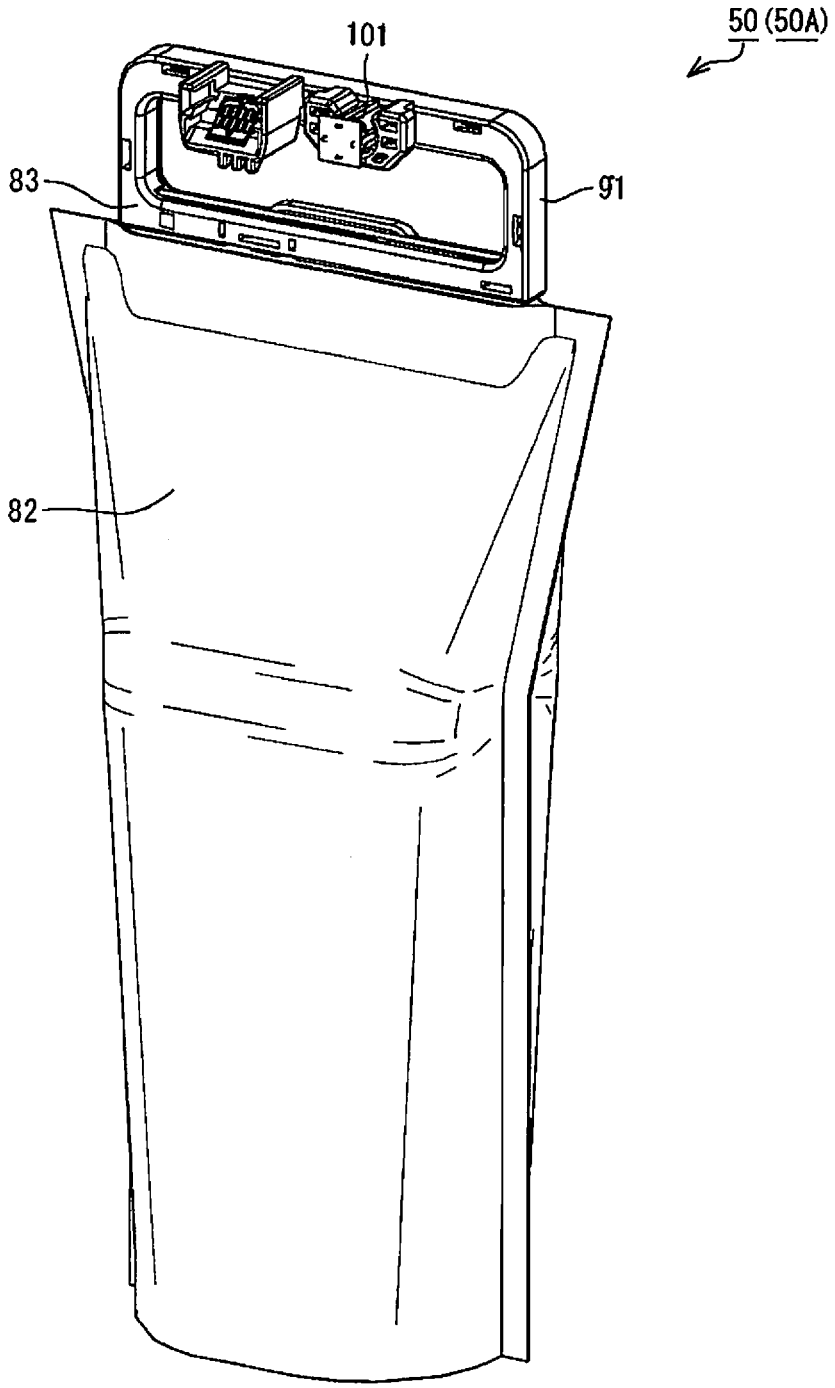
FIG. 2 is a perspective view showing an ink container according to Embodiment 1.
Figure 3:
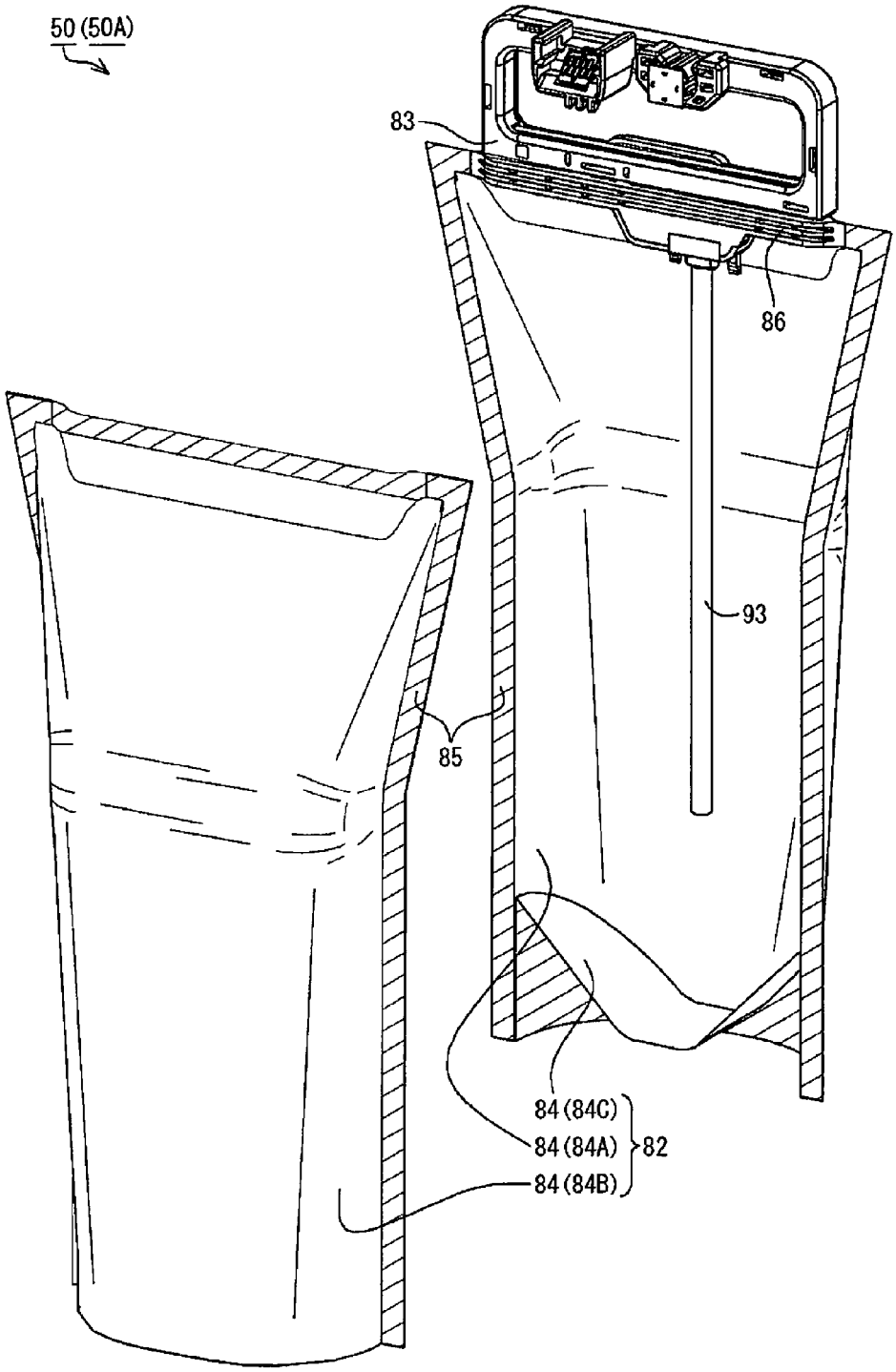
FIG. 3 is an exploded perspective view showing the ink container according to Embodiment 1.

An ink container 50A according to Embodiment 1, as shown in FIG. 2, includes an ink container part 82, which is an example of a liquid container part, and a connection unit 83. The ink container part 82, as shown in FIG. 3, has a configuration in which a plurality of flexible film members 84 are joined to each other. In the ink container part 82, three film members 84 are joined so as to have a bag shape. When individually identifying the three film members 84 in the ink container part 82, the three film members 84 are respectively denoted as a film member 84A, a film member 84B, and a film member 84C. The film member 84A and the film member 84B are laid one on top of the other and adhered to each other at a peripheral region 85. The film member 84C is sandwiched between the film member 84A and the film member 84B. The periphery of the film member 84C is laid on the peripheral region 85 and adhered to the film member 84A and the film member 84B.

The ink container part 82 thus has a bag shape with the film member 84C serving as the bottom. Ink is housed inside the ink container part 82. The ink container part 82 thus functions as an ink container part that houses ink, which is an example of a liquid. Since the ink container part 82 is at least partially flexible, it can prevent a decrease in the pressure inside the ink container part 82 when the ink inside the ink container part 82 is consumed. Note that, in FIG. 3, the peripheral region 85 is hatched in order to facilitate understanding of the configuration. Also note that FIG. 3 shows a state in which the film member 84C is cut between the film member 84A and the film member 84B.

Material such as polyethylene terephthalate (PET), nylon, and polyethylene can be employed for the film member 84A, the film member 84B, and the film member 84C. A laminated structure obtained by laminating films constituted by such materials may also be employed. PET or nylon, which both have excellent shock resistance, can be used for the outer layer of such a laminated structure, and polyethylene, which has excellent ink resistance, can be used for the inner layer, for example. Furthermore, a film or the like having a layer vapor-deposited with aluminum or the like can also be employed. Thus, gas barrier properties can be improved.

The connection unit 83 is sandwiched by the film member 84A and the film member 84B in a portion of the peripheral region 85. The connection unit 83 and the film member 84A are adhered to each other in a portion of the peripheral region 85. Similarly, the connection unit 83 and the film member 84B are adhered to each other in a portion of the peripheral region 85. The portion of the peripheral region 85 where the connection unit 83 is sandwiched by the film member 84A and the film member 84B is thus the portion where the ink container part 82 joins the connection unit 83. An adhering part 86 is provided in the connection unit 83. The film member 84A and the film member 84B are both adhered to the adhering part 86, in a state where the adhering part 86 is sandwiched by the film member 84A and the film member 84B. The ink container part 82 having the film member 84C as the bottom is constituted by the film member 84A, the film member 84B, and the connection unit 83 joining to each other.

Figure 4:
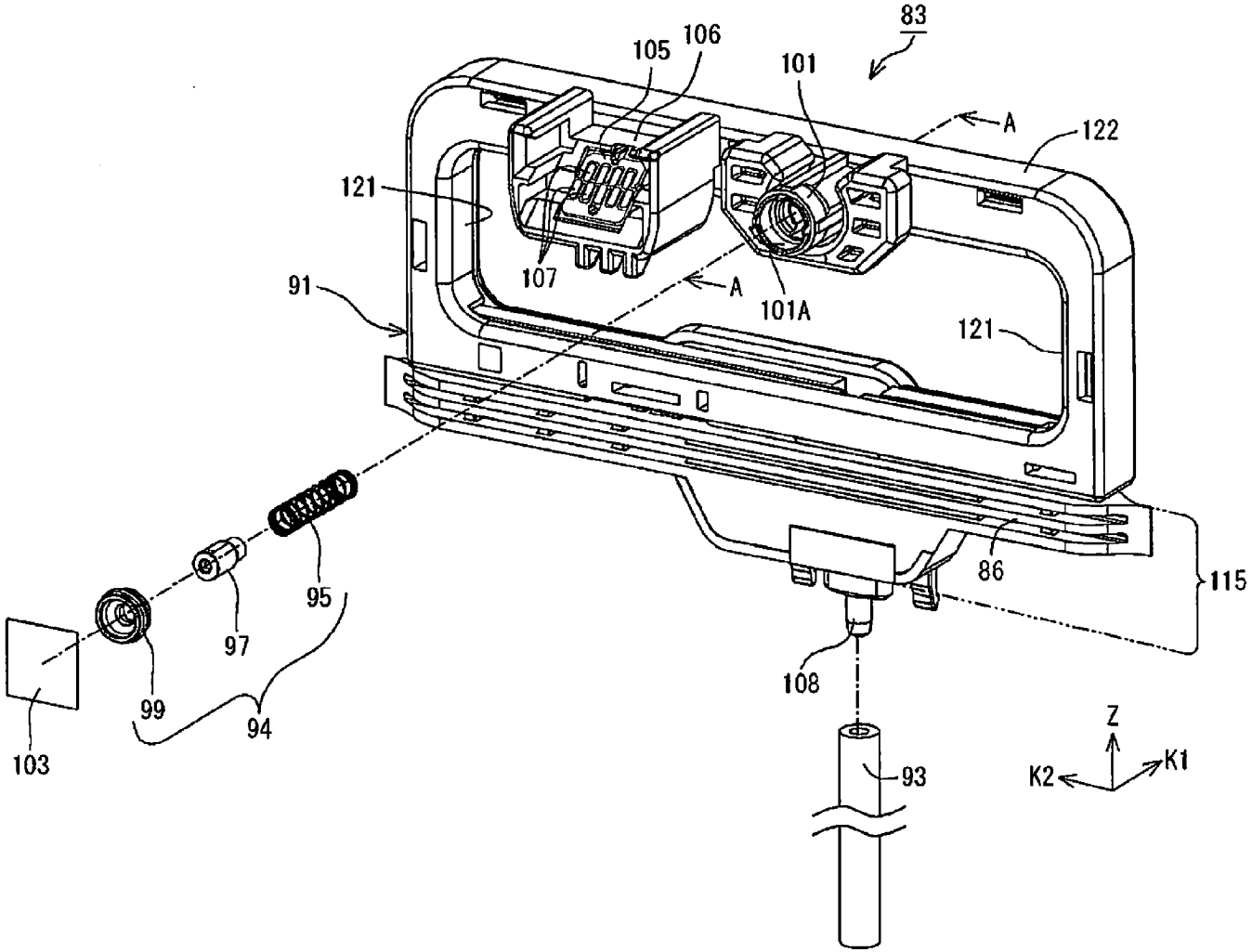
FIG. 4 is an exploded perspective view showing a connection unit according to Embodiment 1.

The connection unit 83, as shown in FIG. 4, includes a handle unit 91, which is an example of a handle part, a tube 93, and a valve unit 94. The valve unit 94 includes a spring 95, a plug (valve body) 97, and a packing (valve seat) 99. The handle unit 91 is located at an end of the ink container part 82. The handle unit 91 includes an ink outlet part 101. The ink outlet part 101 has a cylindrical external appearance. An ink outlet port 101A is formed in the ink outlet part 101. The inside of the ink container part 82 (FIG. 3) is in communication with the outside via the ink outlet part 101. The ink outlet part 101 functions as a liquid outlet part that guides ink, which is an example of a liquid, from the inside of ink container part 82 to the outside. The ink inside the ink container part 82 is guided to the outside of the ink container 50 via the ink outlet port 101A of the ink outlet part 101. The spring 95, the plug 97, and the packing 99 are housed in this order inside the ink outlet part 101. Prior to the ink container 50 being attached to the ink supply apparatus 4, the ink outlet port 101A is closed by a film 103. The inside of the ink container part 82 is thereby maintained in a sealed state.

Also, the connection unit 83 is provided with a circuit substrate 105, which is an example of an electrical contact part. The handle unit 91 is provided with a substrate installation part 106, which is an example of a holding part. The circuit substrate 105 is provided on the substrate installation part 106. The circuit substrate 105 is provided with a plurality of terminal parts 107. The plurality of terminal parts 107 face the opposite side to the handle unit 91 side of the circuit substrate 105. A storage apparatus (not shown in the drawings) such as a non-volatile memory is provided on the opposite side to the terminal parts 107 side of the circuit substrate 105. At least some of the plurality of terminal parts 107 are electrically connected to the storage apparatus.

The handle unit 91 includes an inlet port 108, which is an example of a flow channel connection part. The inlet port 108 is in communication with the inside of the ink container part 82, and guides the ink inside the ink container part 82 to the ink outlet part 101. The inlet port 108 is in communication with the ink outlet part 101. The tube 93 is connected to the inlet port 108. The tube 93, as shown in FIG. 3, is housed in the ink container part 82. An inlet channel to the inlet port 108 is extended to inside the ink container part 82 by the tube 93.

Figure 5:
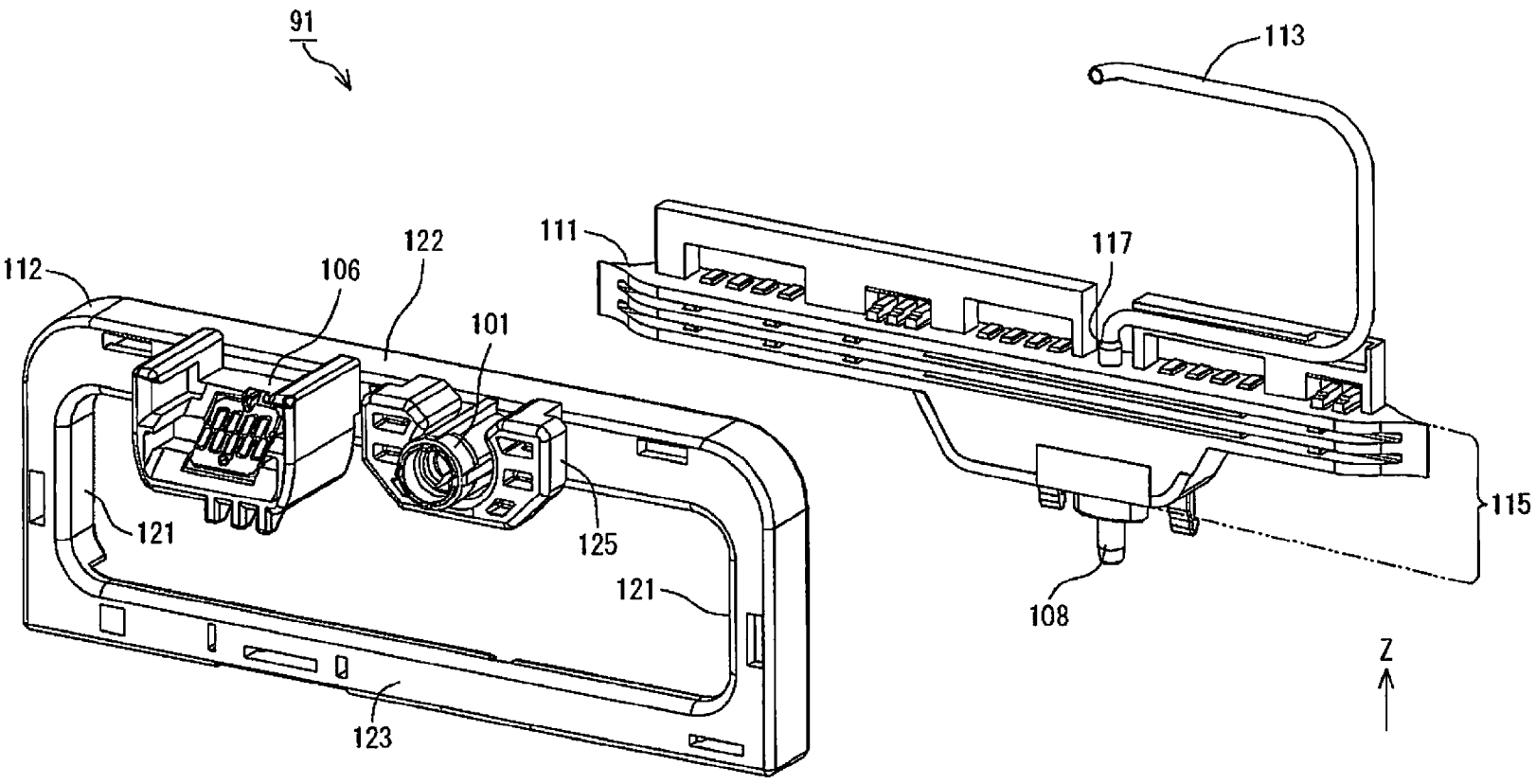
FIG. 5 is an exploded perspective view showing a handle unit according to Embodiment 1.

The handle unit 91, as shown in FIG. 5, includes a base member 111, a handle member 112, and a flow channel member 113. In the handle unit 91, the base member 111 serves as a member that is joined to the ink container part 82, and includes a base part 115. The base part 115 extends in a direction intersecting the Z axis. The adhering part 86 is provided on a side surface of the base part 115. The adhering part 86 provided on the base part 115 and the ink container part 82 are joined to each other, and thus the base member 111 and the ink container part 82 are joined to each other. The inlet port 108 is provided in the base part 115 of the base member 111, and extends along the Z axis. The inlet port 108 projects from the base part 115 in the −Z axis direction. The base member 111 is provided with a connection part 117. In the base member 111, the connection part 117 is provided on the base part 115. The connection part 117 is provided on the opposite side to the inlet port 108 side of the base part 115. The connection part 117 projects from the base part 115 in the Z axis direction. One end side of the flow channel member 113 is connected to the connection part 117.

The handle member 112 is configured to be able to be attached to and detached from the base member 111. In a state where the handle member 112 is attached to the base member 111, the handle member 112 is located in the z axis direction of the base part 115 of the base member 111. Therefore, in the ink container 50 (FIG. 2), the handle member 112 projects further outside than the ink container part 82. The handle member 112 extends along the direction in which the base part 115 of the base member 111 extends. The handle member 112 includes two leg parts 121 and a gripping part 122. The two leg parts 121 are spaced apart from each other in the direction in which the base part 115 extends. Both the two leg parts 121, as shown in FIG. 4, project from the base part 115 in the Z axis direction. Note that in the handle member 112 shown in FIG. 5, the respective ends on the base part 115 side of the two leg parts 121 are connected to each other by a connection part 123.

The gripping part 122 is provided further in the Z axis direction than the two leg parts 121, that is, further on the opposite side to the base part 115 side than the two leg parts 121. Accordingly, the gripping part 122 is located further in the Z axis direction than the base part 115. Therefore, the gripping part 122 is located further on the opposite side to the ink container part 82 side than the base part 115. Of the two leg parts 121, the respective ends on the opposite side to the base part 115 side are connected to the gripping part 122. That is, as shown in FIG. 4, in the handle unit 91, the two leg parts 121 connect the gripping part 122 and the base part 115.

The gripping part 122 extends along the direction in which the base part 115 extends. The two leg parts 121 are both connected to the gripping part 122. The above configuration enables an operator to insert his or her fingers between the gripping part 122 and the base part 115, and grip the gripping part 122. The operator is then able to hold the ink container 50A (FIG. 2) such that it hangs, while continuing to grip the gripping part 122.

As shown in FIG. 5, in the handle unit 91, the ink outlet part 101 and the substrate installation part 106 are provided for the handle member 112. In the handle member 112, the ink outlet part 101 and the substrate installation part 106 are provided on the gripping part 122. The ink outlet part 101 and the substrate installation part 106 project from the gripping part 122 in a direction intersecting the Z axis. The ink outlet part 101 and the substrate installation part 106 are provided on the same side of the gripping part 122. Here, the gripping part 122 is a part of the handle unit 91 that is located on the opposite side to the ink container part 82 side. In the ink container 50A, the gripping part 122 is thus located at the upper end in the vertical direction. Therefore, the ink outlet part 101 and the substrate installation part 106 provided on the gripping part 122 are located at the upper end of the ink container 50A in the vertical direction. Note that the ink outlet part 101 extends in a direction intersecting the direction in which the inlet port 108 extends, that is, in a direction intersecting the Z axis.

The handle member 112 also includes an engaging part 125. The engaging part 125 has a plate-like external appearance, and intersects the ink outlet part 101. The engaging part 125 projects to the outside of the ink outlet part 101. The engaging part 125 has the shape of a flange that projects to the outside of the ink outlet part 101. The engaging part 125 projects further outside than the ink outlet part 101 from the ink outlet part 101. In other words, the engaging part 125 includes a portion that projects further toward the two leg parts 121 side than the ink outlet part 101 and a portion that projects further toward the connection part 123 side than the ink outlet part 101, that is, a portion that projects further in the −Z axis direction than the ink outlet part 101. The engaging part 125 is spaced apart from the gripping part 122. That is, a gap is provided between the engaging part 125 and the gripping part 122.

Figure 6:
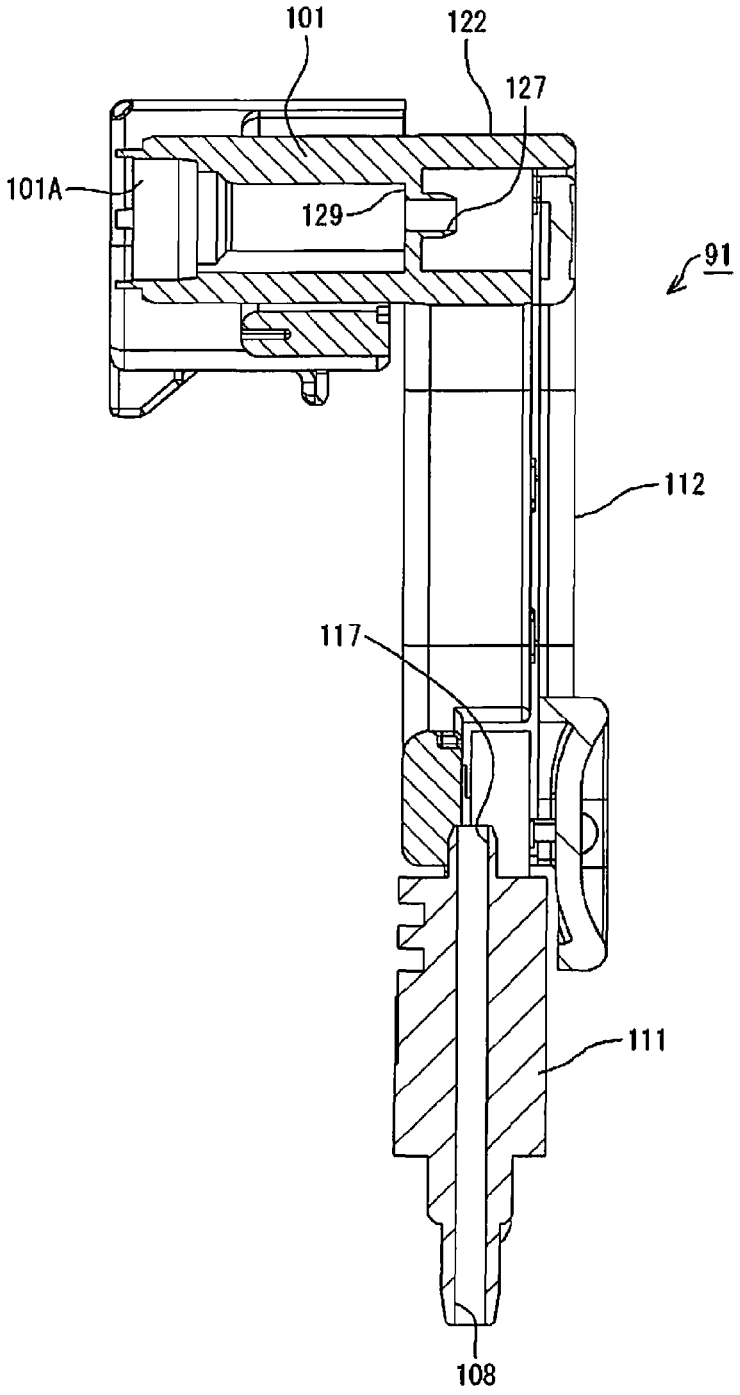
FIG. 6 is a cross-sectional view of the handle unit according to Embodiment 1 cut along a line A-A in FIG. 4.

Here, in the base member 111, the inlet port 108 and the connection part 117 pass through the base member 111 to be in communication with each other as shown in FIG. 6, which is a cross-sectional view of the handle unit 91 cut along a line A-A in FIG. 4. Also, the handle member 112 is provided with a connection part 127, which is located on the opposite side to the ink outlet part 101 side of the gripping part 122. The connection part 127 passes through a bottom part 129 of the ink outlet part 101 from the opposite side to the ink outlet port 101A side of the ink outlet part 101, and communicates with the inside of the ink outlet part 101.

Figure 7:
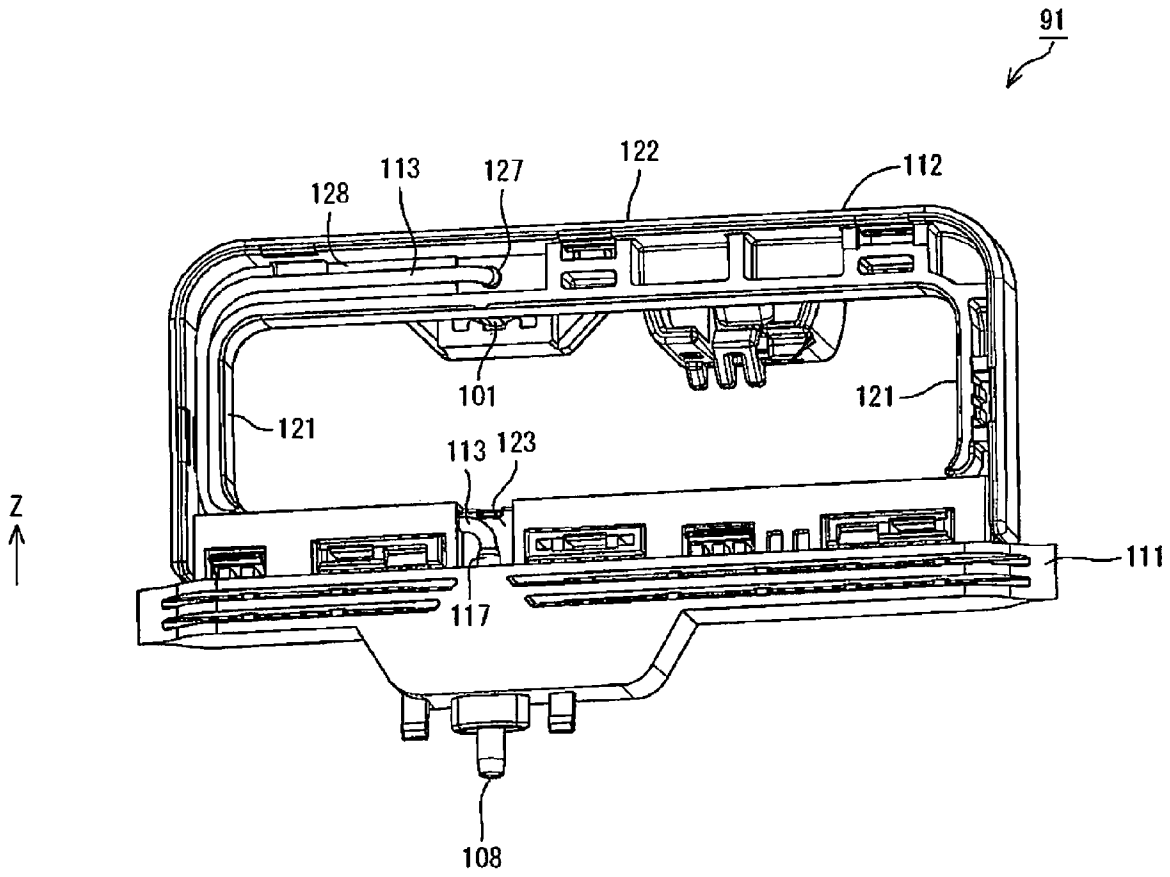
FIG. 7 is a perspective view showing the handle unit according to Embodiment 1.

As shown in FIG. 7 the other end side of the flow channel member 113 is connected to the connection part 127. Due to the above configuration, the inlet port 108 and the ink outlet port 101A are in communication with each other via the connection part 117, the flow channel member 113, the connection part 127, and the ink outlet part 101. Thus, the ink in the ink container part 82 can be guided from the ink outlet port 101A to the outside of the ink container 50A via the handle unit 91. Note that a flexible tube, for example, may be used as the flow channel member 113.

Here, a groove part 128 is formed in the handle member 112 on the opposite side to the ink outlet part 101 side as shown in FIG. 7 so as to extend along the gripping part 122, the leg part 121, and the connection part 123. The groove part 128 is formed between the connection part 117 and the connection part 127 along the passage of the flow channel member 113. In the handle member 112, the groove part 128 is formed so as to be recessed from the opposite side to the ink outlet part 101 side toward the ink outlet part 101 side. The groove part 128 is formed to have a sufficient depth so that the flow channel member 113 can be housed therein. The flow channel member 113 extends along the passage of the groove part 128. The flow channel member 113 is housed within the groove part 128. With this configuration, since at least part of the flow channel member 113 that constitutes a part of the flow channel that is in communication with the ink outlet part 101 from the ink container part 82 is provided in the leg part 121, the amount of ink that can be housed in the ink container 50A can be increased. Also, since the structural elements such as the flow channel member 113 are housed in the handle member 112, the rigidity of the handle member 112 can be enhanced with the structural elements.

Figure 8:
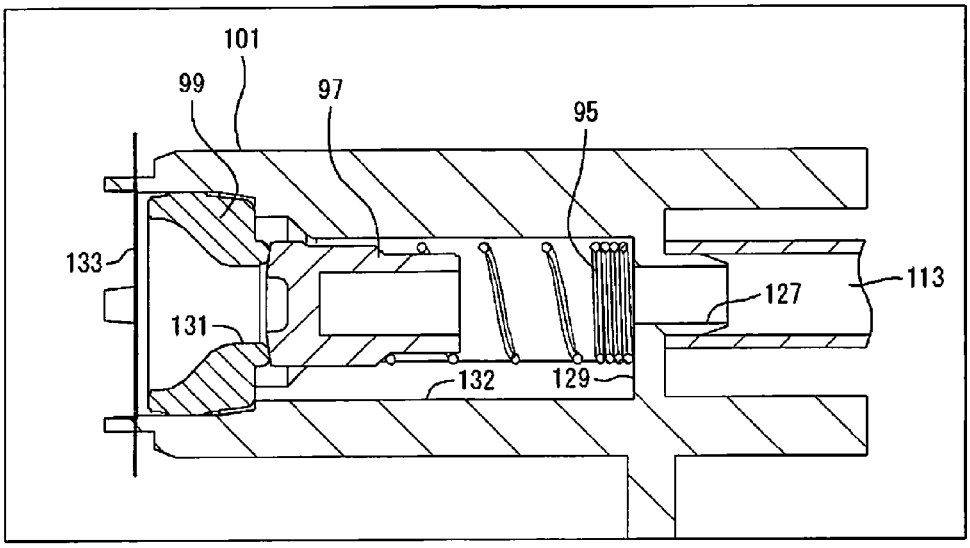
FIG. 8 is an enlarged cross-sectional view of the connection unit according to Embodiment 1 cut along the line A-A in FIG. 4.

As shown in FIG. 8, the spring 95, the plug 97, and the packing 99 are housed inside the ink outlet part 101. The spring 95 is sandwiched by the bottom part 129 of the ink outlet part 101 and the plug 97. The plug 97 is sandwiched by the spring 95 and the packing 99. The plug 97 is thus biased toward the packing 99 side by the spring 95. The packing 99 is constituted by an elastic body such as rubber or an elastomer, for example. The packing 99 is press-fitted into the ink outlet part 101. The packing 99 is provided with an opening 131. The plug 97 is biased toward the packing 99 side in a state of overlapping the opening 131 of the packing 99. The opening 131 of the packing 99 is thus closed by the plug 97. A gap is maintained between the plug 97 and the ink outlet part 101. A gap is also maintained between the spring 95 and the ink outlet part 101. The plug 97 and the spring 95 can thus be displaced inside the ink outlet part 101 in the direction in which the ink outlet part 101 extends.

Here, a groove 132 is provided on the inside of the ink outlet part 101. The groove 132 extends from an end 133 side of the ink outlet part 101 toward the bottom part 129 along the direction in which the ink outlet part 101 extends. The groove 132 reaches further toward the packing 99 side from the bottom part 129 than the spring 95. The groove 132 is provided so as to be recessed from the inner wall of the ink outlet part 101 toward the outer wall. Therefore, in a state where the plug 97 is housed in the ink outlet part 101, the space enclosed by the plug 97 and the groove 132 can be utilized as an ink flow channel.

Figure 9:
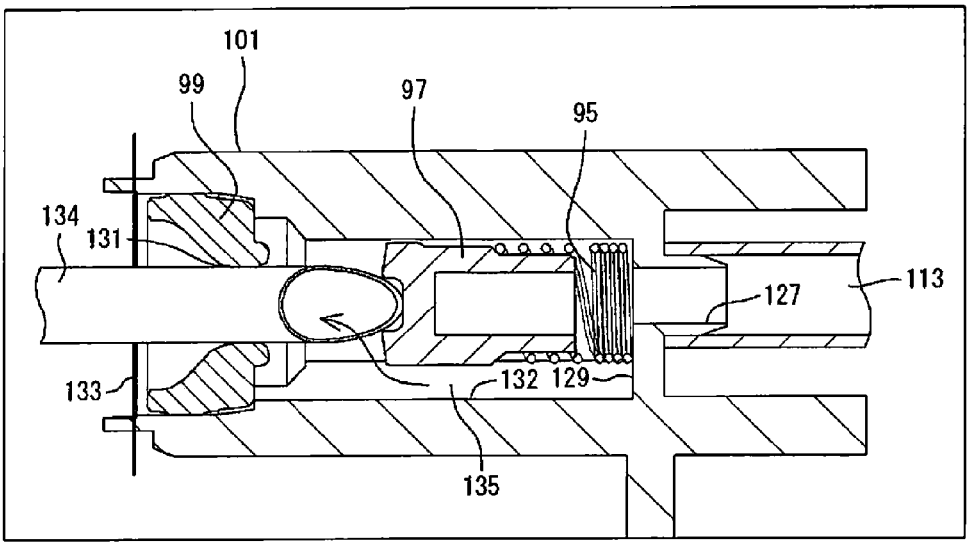
FIG. 9 is an enlarged cross-sectional view of the connection unit according to Embodiment 1 cut along the line A-A in FIG. 4.

A supply needle 134 is inserted into the opening 131 of the packing 99, as shown in FIG. 9, when the ink container 50A is attached to the ink supply apparatus 4 (FIG. 1). At this time, the plug 97 is pushed by the supply needle 134 and displaced toward the bottom part 129 side. The supply needle 134 is formed to be hollow. Also, the supply needle 134 is in communication with the ink supply tube 57 (FIG. 1). As shown by the arrow in the diagram, ink can thereby be supplied from a flow channel 135 enclosed by the groove 132 and the plug 97 to the ink supply tube 57 (FIG. 1) via the supply needle 134. Note that the supply needle 134 is provided inside the casing 53 of the ink supply apparatus 4.

Figure 10:
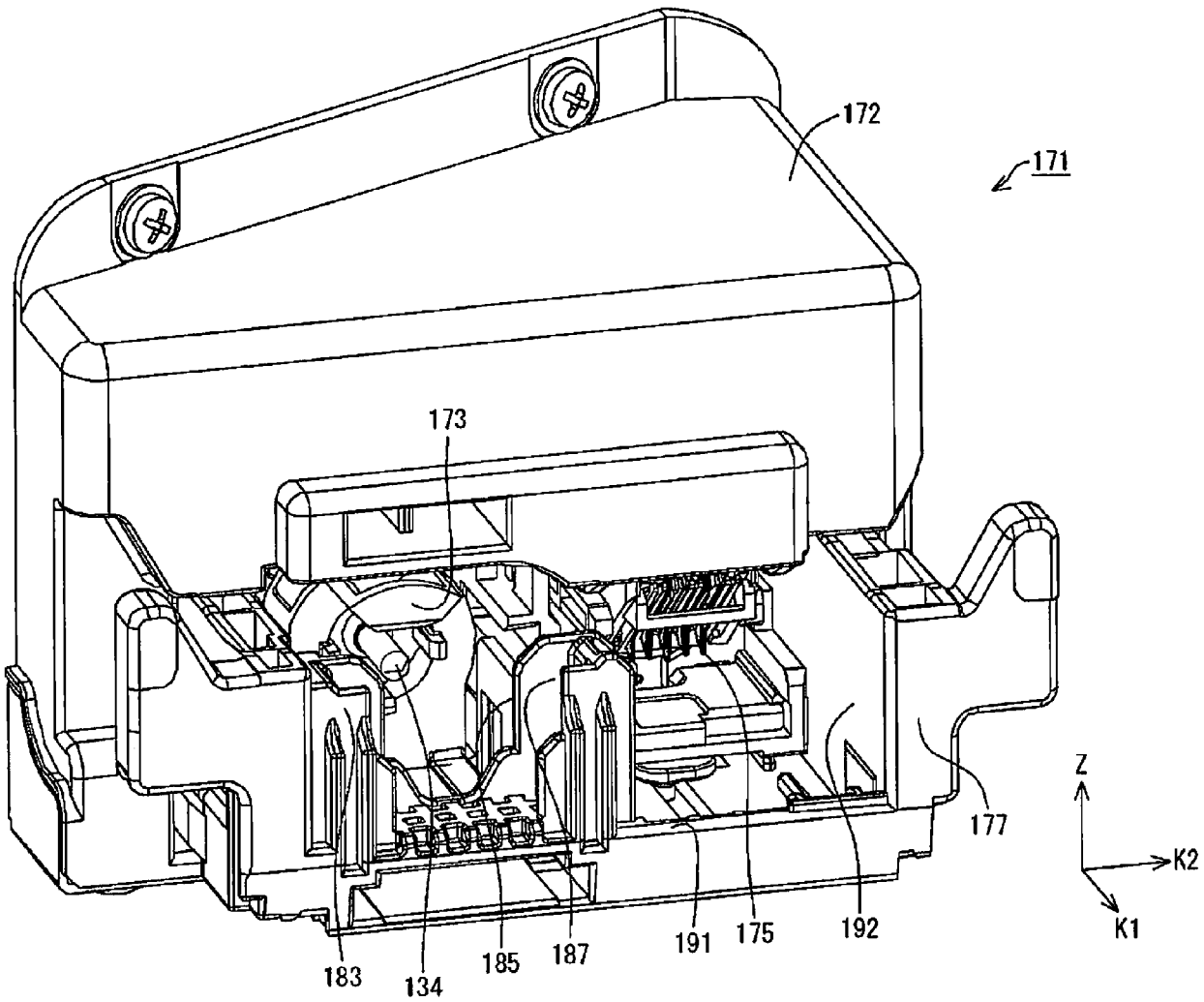
FIG. 10 is a perspective view showing the attachment/detachment unit according to the embodiment.

The following describes attachment/detachment units 171 provided in the ink supply apparatus 4. The attachment/detachment units 171 include a mechanism for attaching and detaching the ink containers 50 to and from the ink supply apparatus 4. The attachment/detachment units 171 support the liquid containers 50 such that the ink containers 50 are attachable and detachable. The number of attachment/detachment units 171 provided in the ink supply apparatus 4 is the same as the number of ink containers 50 that can be attached to the ink supply apparatus 4. In other words, an attachment/detachment unit 171 is provided for every ink container 50 that is to be attached to the ink supply apparatus 4. The attachment/detachment unit 171, as shown in FIG. 10, includes a holder 172, an ink inlet part 173, which is an example of a liquid inlet part, a contact point mechanism 175, which is an example of an electrical connection part, and a movable member 177, which is an example of a movable supporting part. The holder 172 is a member that supports the attachment/detachment unit 171. The ink inlet part 173 and the contact point mechanism 175 are provided inside the holder 172. The holder 172 may be fixed directly to the printer 3, or fixed to the printer 3 via the casing 53 of the ink supply apparatus 4.

The ink inlet part 173 includes the aforementioned supply needle 134. The ink inlet part 173 functions as a liquid inlet part through which ink guided from the inside of the ink container part 82 of the ink container 50 via the ink outlet part 101 is guided to the relay apparatus 9. The supply needle 134 is in communication with the ink supply tube 57. Here, the direction in which the supply needle 134 extends in the ink supply apparatus 4 is given as a K1 direction. The Z axis direction in the ink supply apparatus 4 is the same as the Z axis direction in the liquid injection system 1. The direction that is orthogonal to both the K1 direction and the Z axis direction is given as a K2 direction. According to these definitions, in the handle unit 91 of the ink container 50, the ink outlet part 101 and the base part 115, as shown in FIG. 4, respectively extend along the K1 direction and the K2 direction in the ink supply apparatus 4. Similarly, the gripping part 122 extends along the K2 direction.

The contact point mechanism 175 (FIG. 10) is a connection part that is electrically connected to the circuit substrate 105 of the ink container 50. In a state where the ink container 50 is attached to the attachment/detachment unit 171, at least some of the plurality of terminal parts 107 (FIG. 4) of the circuit substrate 105 are in contact with the contact point mechanism 175. The contact point mechanism 175 is electrically connected to the control part 11 via the flexible cable 31 (FIG. 1). The contact point mechanism 175 and the storage apparatus (not shown in the drawings) of the ink container 50 are electrically connected via the circuit substrate 105, and accordingly various sorts of information can be transmitted between the control part 11 and the storage apparatus of the ink container 50.

The movable member 177 is configured to be movable back and forth along the K1 direction relative to the holder 172. The movable member 177 is provided in a position overlapping the ink inlet part 173, and spans an area straddling the ink inlet part 173 and the contact point mechanism 175 in the K2 direction, when the attachment/detachment unit 171 is viewed from the K1 direction. The movable member 177 is provided with a supporting part 183. The supporting part 183 is provided in a position overlapping the ink inlet part 173, when the attachment/detachment unit 171 is viewed from the K1 direction. The supporting part 183 is provided with a cutaway part 185 at a portion overlapping the supply needle 134. Thus, when the movable member 177 is moved toward the ink inlet part 173 along the opposite direction to the K1 direction, the supply needle 134 of the ink inlet part 173 can be inserted into the cutaway part 185 of the supporting part 183.

Figure 11:
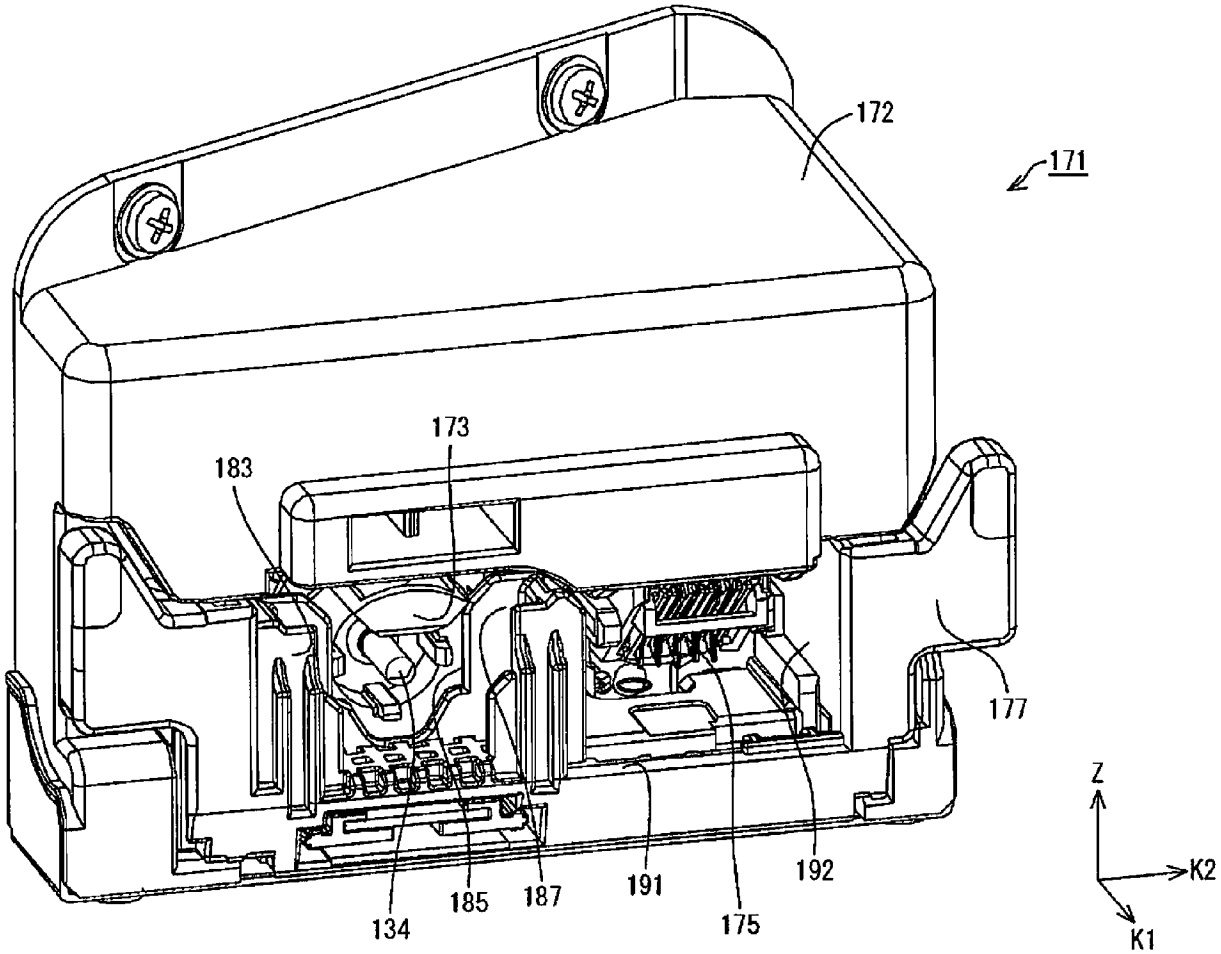
FIG. 11 is a perspective view showing the attachment/detachment unit according to the embodiment.

The supporting part 183 is provided with a recessed part 187. In the supporting part 183, the recessed part 187 is provided so as to be recessed in the −Z axis direction. The recessed part 187 is provided to span an area straddling the cutaway part 185 in the K2 direction. Thus, when the movable member 177 is moved toward the ink inlet part 173 along the opposite direction to the K1 direction as shown in FIG. 11, the supply needle 134 can advance into the recessed part 187 via the cutaway part 185 of the supporting part 183. The engaging part 125 (FIG. 5) provided on the handle unit 91 of the ink container 50 can be inserted into the recessed part 187. In a state in which the ink outlet part 101 of the ink container 50 faces toward the ink inlet part 173 side of the attachment/detachment unit 171, the engaging part 125 of the ink container 50 can be inserted into the recessed part 187 from the Z axis direction of the recessed part 187. Note that the engaging part 125 is an example of a first engaging part, and the recessed part 187 is an example of a first engaged part.

The movable member 177 is provided with a supporting part 191. The supporting part 191 is provided in a position overlapping the contact point mechanism 175, when the attachment/detachment unit 171 is viewed from the K1 direction. The supporting part 191 is provided with a cutaway part 192 at a portion overlapping the contact point mechanism 175. The supporting part 191 is configured such that the substrate installation part 106 of the connection unit 83 can be received by the cutaway part 192. The substrate installation part 106 can engage with the cutaway part 192 of the supporting part 191 in the −Z axis direction. When the engaging part 125 of the ink container 50 is inserted into the supporting part 183, the substrate installation part 106 is accordingly inserted into the cutaway part 192 of the supporting part 191. The supporting part 191 is configured to be able to support the substrate installation part 106 in a state where the substrate installation part 106 engages with the supporting part 191. Note that the substrate installation part 106 is an example of a second engaging part, and the cutaway part 192 of the supporting part 191 is an example of a second engaged part.

Here, a state, in the attachment/detachment unit 171, where the movable member 177 projects further in the K1 direction than the holder 172, as shown in FIG. 10, is called a disconnected state. The position of the movable member 177 in the disconnected state is called a disconnected position. Note that in the disconnected state, the ink inlet part 173 is positioned further in the −K1 direction than the cutaway part 185 of the movable member 177. In the disconnected state, the ink inlet part 173 is thus spaced apart from the ink outlet part 101. Therefore, the disconnected state is a state in which the ink outlet part 101 and the ink inlet part 173 are not connected. In the disconnected state, the attached state of the attachment/detachment unit 171 to the ink container 50 is released. The disconnected state thus is also called a release state. The disconnected position is also called a release position. In the release position, the ink outlet part 101 and the ink inlet part 173 are spaced apart from each other. Also, in the release position, the contact point mechanism 175 and the terminal parts 107 of the circuit substrate 105 are spaced apart from each other.

When the movable member 177 is displaced from the release position to a connected position shown in FIG. 11, the supply needle 134 advances into the cutaway part 185 of the movable member 177. In the state where the supply needle 134 has advanced into the cutaway part 185 of the movable member 177, the ink outlet part 101 and the supply needle 134 are connected to each other. The state in which the ink outlet part 101 and the supply needle 134 are connected to each other is called a connected state. The position of the movable member 177 in the connected state is called a connected position. In the connected state, the ink outlet part 101 and the supply needle 134 are connected to each other. Also, in the connected position, the contact point mechanism 175 and the terminal parts 107 of the circuit substrate 105 are in contact with each other.

Figure 12:
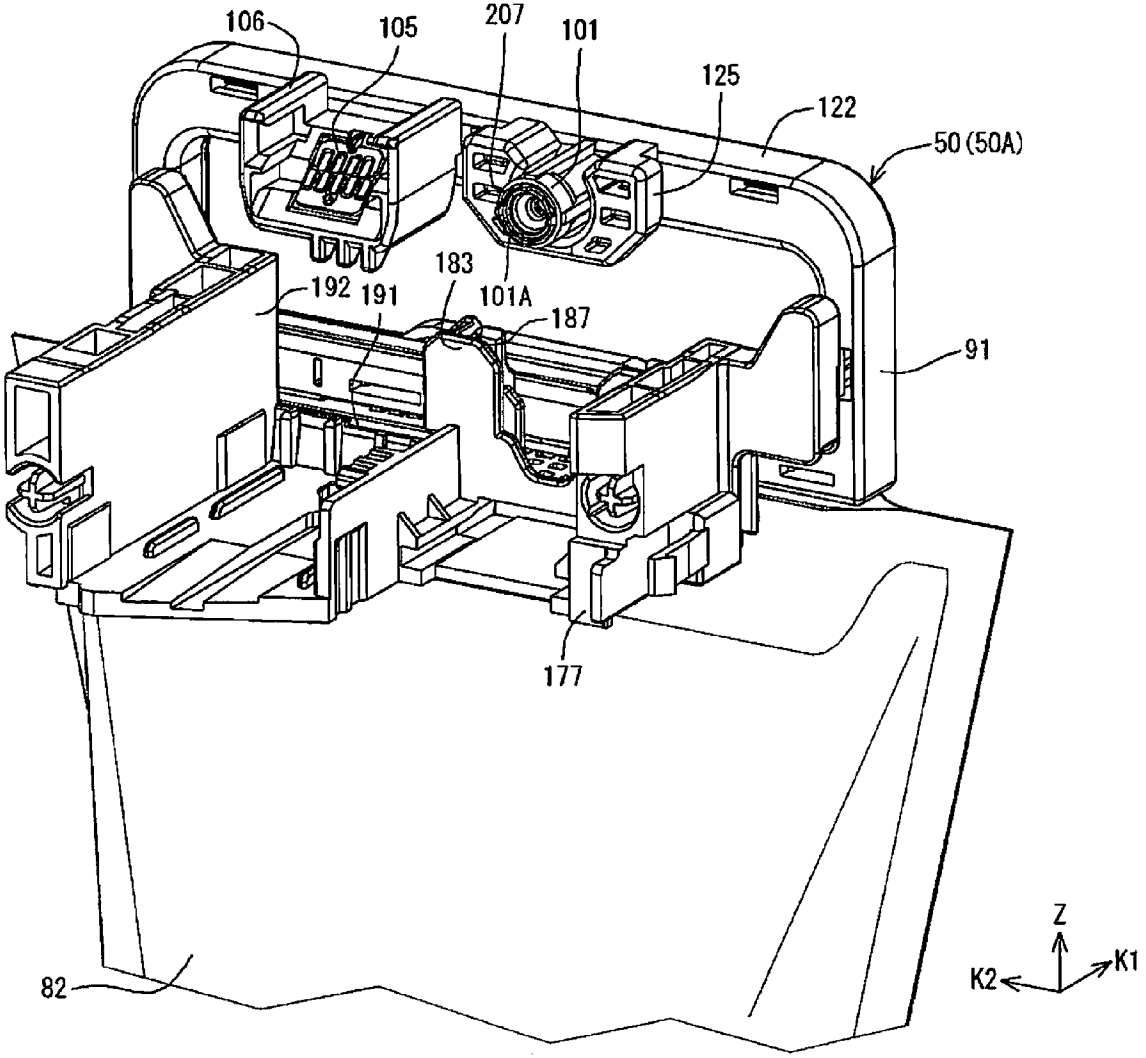
FIG. 12 is a drawing illustrating procedures for attaching the ink container to the attachment/detachment unit according to Embodiment 1.

The following describes procedures for attaching the ink container 50 to the attachment/detachment unit 171 (an attachment method). First, as shown in FIG. 12, when the movable member 177 is located in the release position, the engaging part 125 of the ink container 50 is positioned in the Z axis direction of the recessed part 187 of the movable member 177, with the ink outlet part 101 of the ink container 50 facing toward the ink inlet part 173 side of the attachment/detachment unit 171. At this time, the substrate installation part 106 of the connection unit 83 faces the supporting part 191 of the movable member 177 along the Z axis. At this time, the operator can easily position the engaging part 125 in the Z axis direction of the recessed part 187 of the movable member 177 by gripping the gripping part 122 of the ink container 50 and supporting the ink container 50. Note that in FIG. 12, the holder 172, the ink inlet part 173, and the contact point mechanism 175 of the attachment/detachment unit 171 are omitted from the drawing in order to facilitate understanding of the configuration.

Here, when the operator grips the gripping part 122 and supports the ink container 50, the ink outlet part 101 is located on the upper side of the ink container 50. The ink outlet part 101 is thus easy to see. When the operator grips the gripping part 122 and supports the ink container 50, an end surface 207 of the ink outlet part 101 is orientated in the −K1 direction intersecting the Z axis direction in which the handle unit 91 projects from the ink container part 82. In other words, when the operator grips the gripping part 122 and supports the ink container 50, the ink outlet port 101A is orientated in the −K1 direction intersecting the direction of gravity. Therefore, when the operator grips the gripping part 122 and supports the ink container 50, it is unlikely that the end surface 207 and the ink outlet port 101A of the ink outlet part 101 overlap the gripping part 122 from the operator's view point, and accordingly the ink outlet port 101A is easy to see, and the operator can attach the ink container 50 to the attachment/detachment unit 171 while paying attention to the end surface 207 and the ink outlet port 101A of the ink outlet part 101. The operator can thus easily position the engaging part 125 in the Z axis direction of the recessed part 187 of the movable member 177. Also, when the operator grips the gripping part 122 and supports the ink container 50, the ink outlet port 101A is orientated in a direction that intersects the direction of gravity, and accordingly it is easy to prevent a foreign object such as dust from attaching to the ink outlet port 101A.

Figure 13:
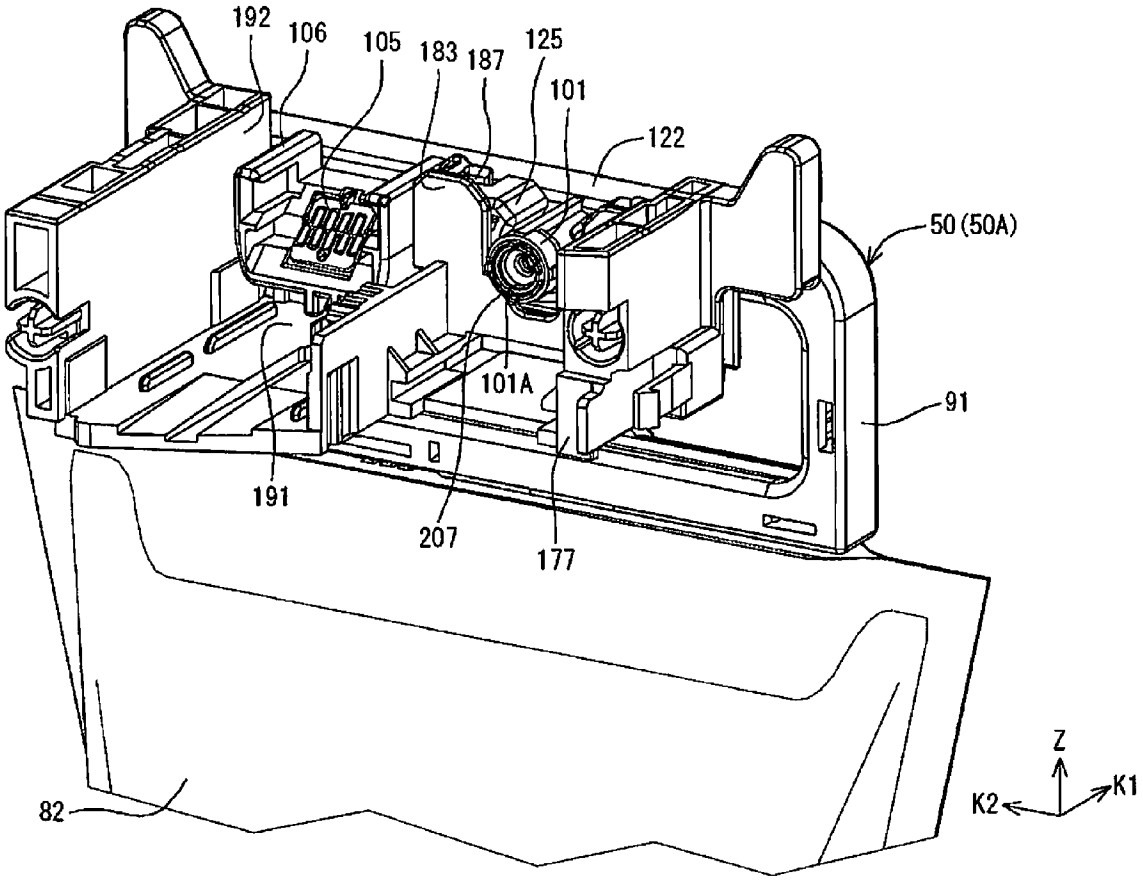
FIG. 13 is a drawing illustrating procedures for attaching the ink container to the attachment/detachment unit according to Embodiment 1.

Next, as shown in FIG. 13, the ink container 50 is lowered in the −Z axis direction, so that the engaging part 125 engages in the recessed part 187 of the movable member 177. As a result, the ink container part 82 is supported by the attachment/detachment unit 171 via the handle unit 91. As a result, the ink container 50 is brought into a suspended state by the engaging part 125 being supported by the supporting part 183. In this way, by engaging the engaging part 125 in the recessed part 187 of the movable member 177, it is easy to attach/detach the ink container 50 to/from the attachment/detachment unit 171. Note that in FIG. 13, the holder 172, the ink inlet part 173, and the contact point mechanism 175 of the attachment/detachment unit 171 are omitted from the drawing in order to facilitate understanding of the configuration.

Figure 14:
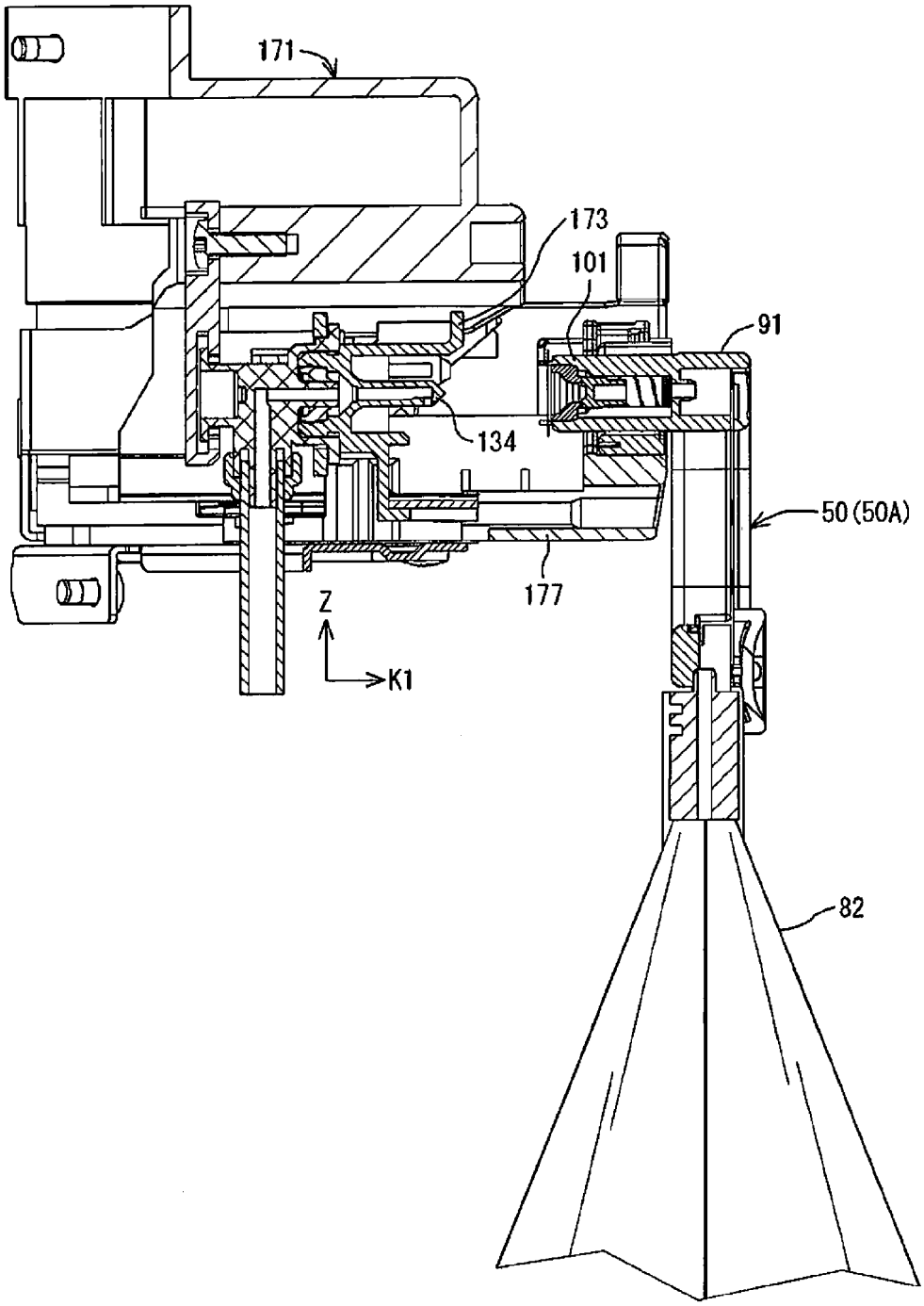
FIG. 14 is a drawing illustrating procedures for attaching the ink container to the attachment/detachment unit according to Embodiment 1.

In this situation, since the movable member 177 is in the release position, the ink outlet part 101 and the ink inlet part 173 are spaced apart from each other as shown in FIG. 14. In other words, when the movable member 177 is in the release position, the connection of the ink outlet part 101 and the ink inlet part 173 is released. Note that FIG. 14 shows a cross section of the attachment/detachment unit 171 and the ink container 50 cut along the line A-A in FIG. 4.

Figure 15:
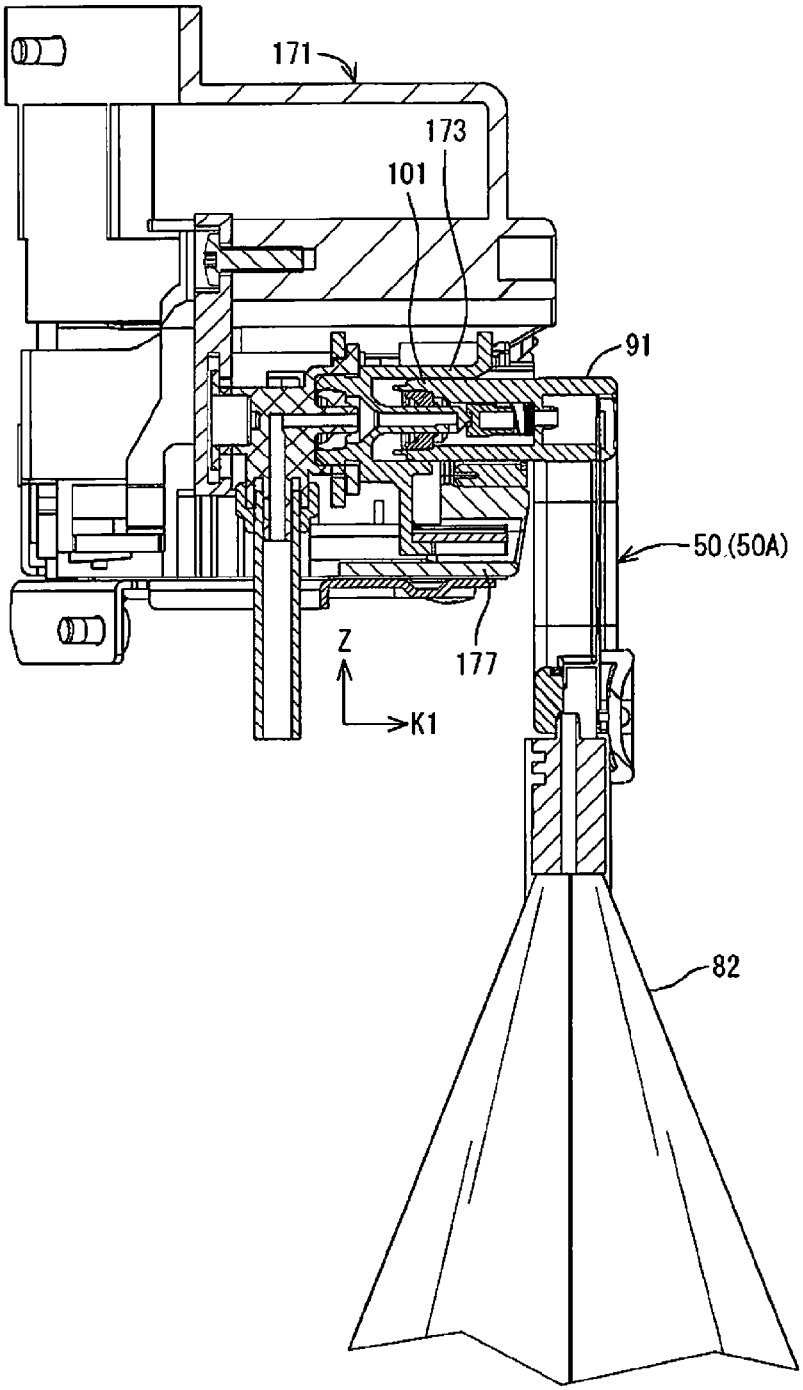
FIG. 15 is a drawing illustrating procedures for attaching the ink container to the attachment/detachment unit according to Embodiment 1.

Then, by displacing the movable member 177 to the connected position as shown in FIG. 15, the ink outlet part 101 can be moved in the −K1 direction. As a result, the ink outlet part 101 and the ink inlet part 173 can be connected, and the contact point mechanism 175 and the terminal parts 107 of the circuit substrate 105 can be connected. Note that FIG. 15 shows a cross section of the attachment/detachment unit 171 and the ink container 50 cut along the line A-A in FIG. 4. Note that in order to detach the ink container 50 from the ink supply apparatus 4, the above-described attachment method is performed in reverse order. In other words, in order to detach the ink container 50 from the ink supply apparatus 4, first, the movable member 177 is displaced from the connected position to the release position. Next, by gripping the gripping part 122 of the ink container 50 and lifting up the ink container 50 from the movable member 177 in the Z axis direction, the ink container 50 can be detached from the ink supply apparatus 4.

With the ink container 50A according to Embodiment 1, the ink container 50 can be replaced with a new ink container 50 when the ink in the ink container 50 has been consumed and the amount of ink remaining in the ink container part 82 is inadequate. As a result, the supply of ink to the printer 3 can be immediately continued. In the ink container 50A, the ink outlet part 101 is located on the gripping part 122, which is the portion on the opposite side to the ink container part 82 side of the handle unit 91. Therefore, when the operator grips the gripping part 122 such that the ink container 50A hangs, the ink outlet part 101 is located on the upper side of the ink container 50A. Accordingly, the ink outlet part 101 is easy to see. As a result, the ink outlet part 101 can be easily attached to and detached from the ink inlet part 173.

Also, in the ink container 50A, the circuit substrate 105 is provided on the handle unit 91. Therefore, when the operator grips the handle member 112 such that the ink container 50A hangs, the circuit substrate 105 is located on the upper side of the ink container 50A. Accordingly, the circuit substrate 105 is easy to see. As a result, it is easy to connect the circuit substrate 105 to the contact point mechanism 175 and release the connection. Furthermore, in the ink container 50A, the circuit substrate 105 is located on the gripping part 122 of the handle unit 91, which is the portion on the opposite side to the ink container part 82 side. Therefore, when the operator grips the gripping part 122 such that the ink container 50A hangs, the circuit substrate 105 is located on the upper side of the ink container 50A. Accordingly, the circuit substrate 105 is even easier to see. As a result, it is easy to connect the circuit substrate 105 to the contact point mechanism 175 and release the connection.

Also, in the ink supply apparatus 4, the ink outlet part 101 can be connected to the ink inlet part 173 by displacing the movable member 177 from the release position to the connected position with the engaging part 125 of the handle unit 91 of the ink container 50A engaging with the recessed part 187 of the movable member 177 of the attachment/ detachment unit 171. Therefore, operations related to connecting the ink outlet part 101 and the ink inlet part 173 and releasing the connection can be easily performed, and the ink outlet part 101 can be even more easily attached to and detached from the ink inlet part 173.

Note that regarding the ink container 50A, in the handle unit 91, part of the flow channel between the inlet port 108 and the ink outlet part 101 is constituted by the flow channel member 113. However, the flow channel between the inlet port 108 and the ink outlet part 101 is not limited to the configuration above. For example, a method according to which the flow channel member 113 is omitted and the flow channel is constituted by sealing the groove part 128 with a film member or the like may be adopted as a method for constituting the flow channel between the inlet port 108 and the ink outlet part 101. This configuration achieves the same effect.

Figure 16:
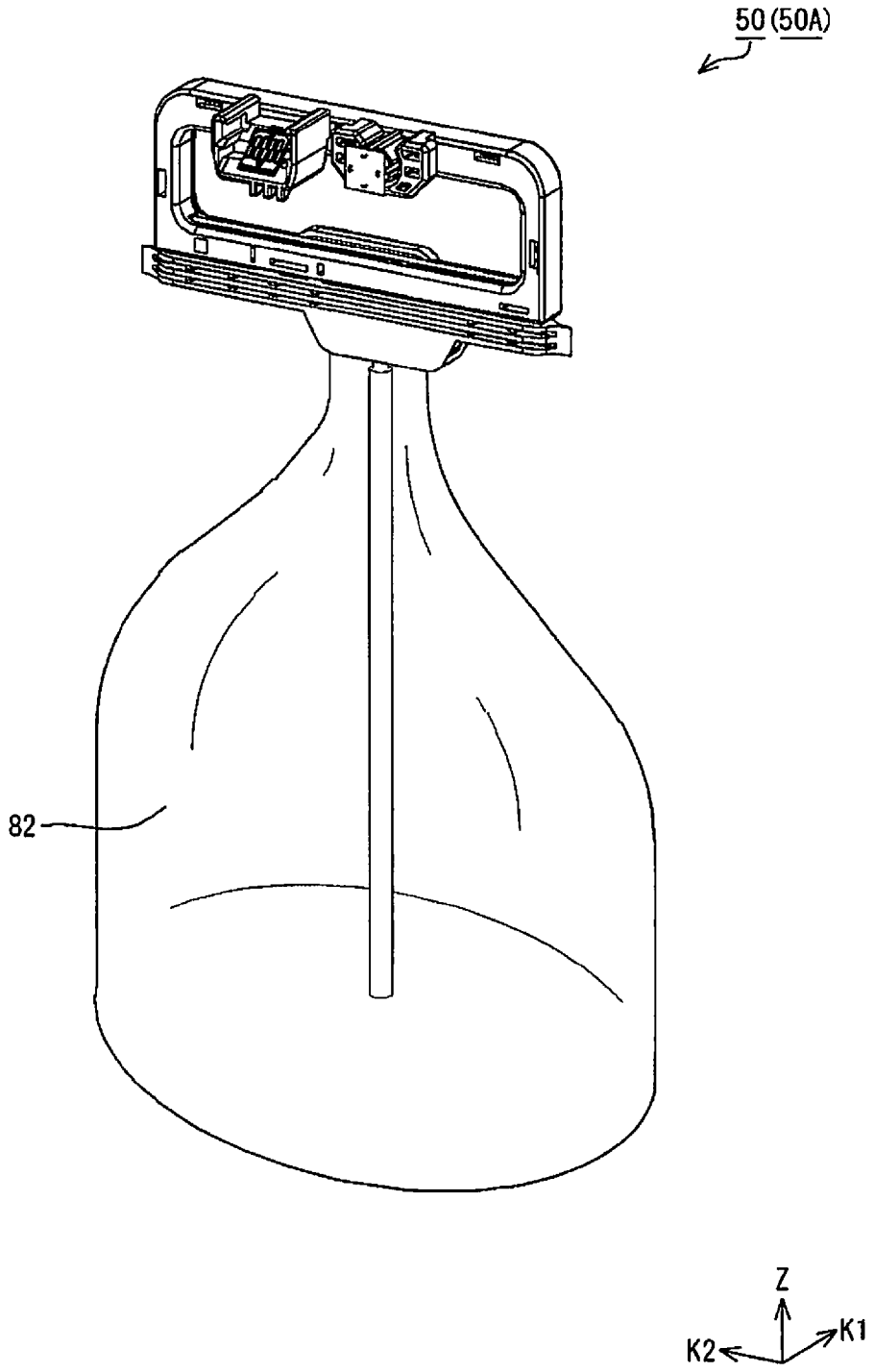
FIG. 16 is a perspective view showing another example of an ink supply set according to Embodiment 1.

Regarding the ink container 50A, an example is taken in which the film member 84A, the film member 84B, and the film member 84C, which are flexible, are joined to constitute the ink container part 82. However, the configuration of the ink container part 82 is not limited to the configuration above. For example, as shown in FIG. 16, the ink container part 82 may be configured by employing a flexible container formed by blow molding. This configuration achieves the same effect. Furthermore, the ink container part 82 is not limited to a flexible container formed by blow molding, and a container with high rigidity formed by resin injection molding or the like may be adopted. This configuration achieves the same effect.

Embodiment 2

Figure 17:
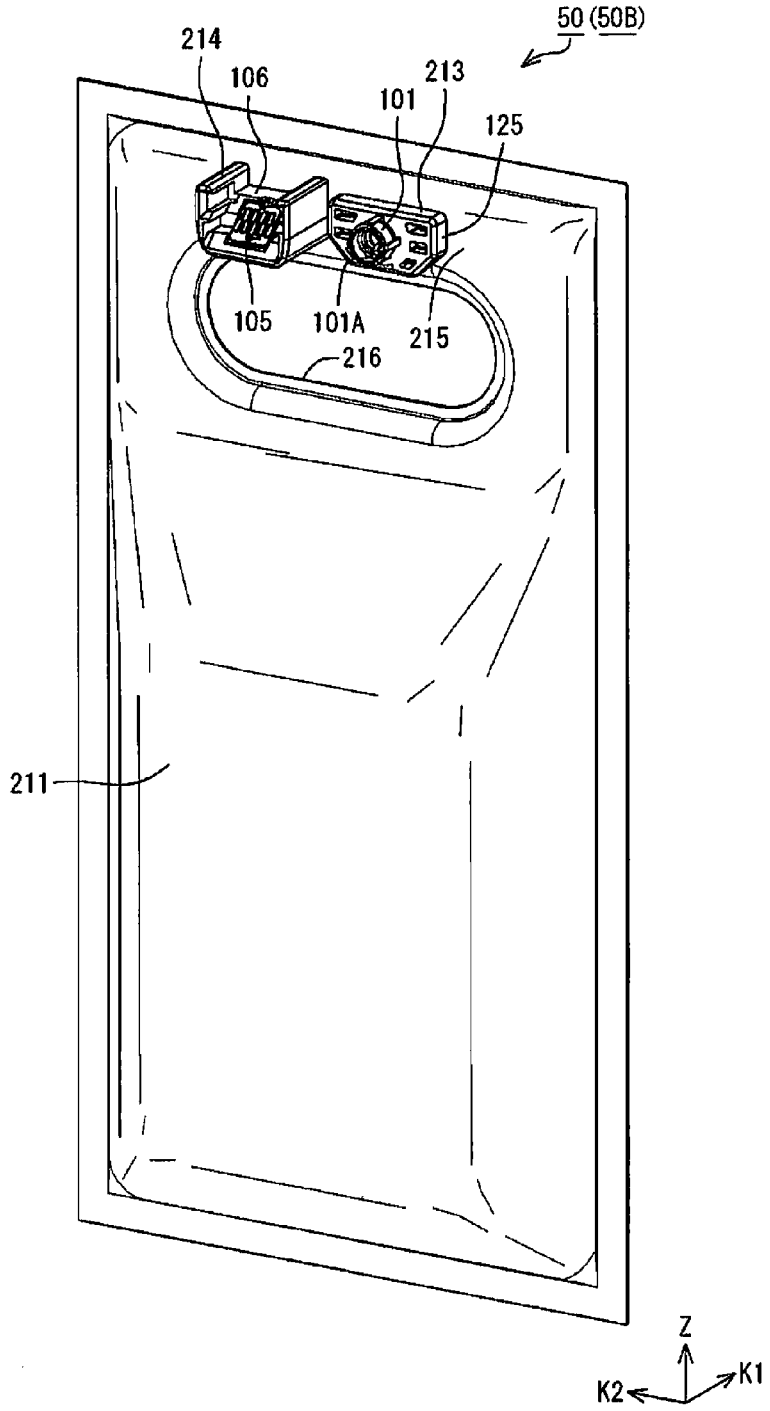
FIG. 17 is a perspective view showing an ink container according to Embodiment 2.

An ink container 50B according to Embodiment 2, as shown in FIG. 17, includes an ink container part 211, an ink outlet unit 213, and an electrical contact unit 214. In Embodiment 2, the same elements as those in Embodiment 1 are given the same reference signs as in Embodiment 1, and the detailed description thereof is omitted. The ink container part 211 has a configuration in which a plurality of flexible film members 84 are joined so as to have a bag shape. The ink container part 211 is provided with a handle part 215, which is formed at an end in the Z axis direction. The ink container part 211 is provided with an opening 216 that passes through the ink container part 211 in the K1 direction. Of the ink container part 211, the portion that is located in the Z axis direction of the opening 216 is configured as the handle part 215.

This configuration enables the operator to insert his or her fingers into the opening 216, and grip the handle part 215. The operator is then able to hold the ink container 50B such that it hangs, while continuing to grip the handle part 215. Note that in the ink container part 211, two film members 84 are joined with each other along the periphery of the opening 216. Therefore, in the ink container part 211, the portion around the opening 216, including the handle part 215, is configured to have a bag shape. For this reason, in the ink container part 211, ink can be housed in the portion around the opening 216, including the handle part 215.

The ink outlet unit 213 includes the ink outlet part 101, the engaging part 125, and the valve unit 94 (FIG. 4). The ink outlet unit 213 has a configuration in which the ink outlet part 101, the engaging part 125, and the valve unit 94 are taken out of the connection unit 83 in Embodiment 1 (FIG. 4). Note that in the ink outlet unit 213, the engaging part 125 is formed on the ink outlet part 101. The ink outlet unit 213 is provided on the handle part 215. Therefore, the ink outlet part 101 is in communication with the ink container part 211 at the handle part 215. In other words, ink inside the ink container part 211 reaches the ink outlet part 101 via the handle part 215.

The electrical contact unit 214 includes the substrate installation part 106 and the circuit substrate 105. The electrical contact unit 214 has a configuration in which the substrate installation part 106 and the circuit substrate 105 are taken out of the connection unit 83 in Embodiment 1 (FIG. 4). The electrical contact unit 214 is provided on the handle part 215. In the ink container 50B, the ink outlet unit 213 and the electrical contact unit 214 are provided on the same side of the ink container part 211. Also, in the ink container 50B, the ink outlet unit 213 and the electrical contact unit 214 are arranged along the K2 direction.

The following describes an example of an attachment method for attaching the ink container 50B to the attachment/detachment unit 171. In the case of the ink container 50B, first, as in Embodiment 1, the engaging part 125 of the ink outlet unit 213 is brought into engagement with the recessed part 187 (FIG. 10) of the movable member 177. At this time, the substrate installation part 106 of the electrical contact unit 214 is inserted into the cutaway part 192 of the movable member 177. Next, by displacing the movable member 177 from the release position to the connected position, the ink outlet part 101 and the ink inlet part 173 are connected, and the contact point mechanism 175 and the terminal parts 107 of the circuit substrate 105 can be connected.

The ink container 50B in Embodiment 2 achieves an effect that is the same as the effect of Embodiment 1. Furthermore, according to Embodiment 2, the handle part 215 is configured as a part of the ink container part 211, and accordingly the number of constituent parts can be smaller than that of Embodiment 1.

Embodiment 3

Figure 18:
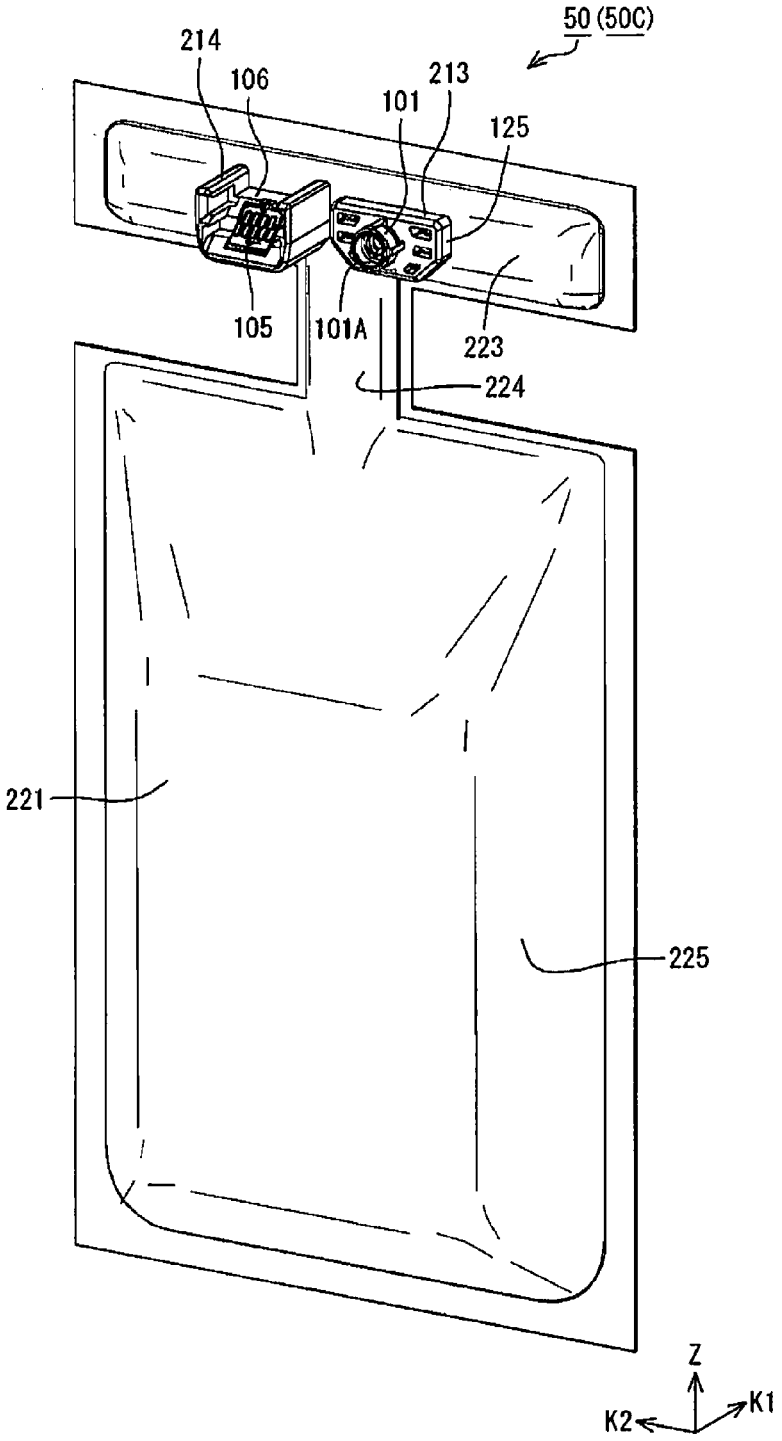
FIG. 18 is a perspective view showing an ink container according to Embodiment 3.

An ink container 50C according to Embodiment 3, as shown in FIG. 18, includes an ink container part 221, the ink outlet unit 213, and the electrical contact unit 214. In Embodiment 3, the same elements as those in Embodiment 1 and Embodiment 2 are given the same reference signs as in Embodiment 1 and Embodiment 2, and the detailed description thereof is omitted. The ink container part 221 has a configuration in which a plurality of flexible film members are joined so as to have a bag shape. The ink container part 221 is provided with a handle part 223, which is formed at an end in the Z axis direction.

In the ink container part 221, a leg part 224 is formed in the −Z axis direction of the handle part 223. The handle part 223 is continuous with a main body part 225 of the ink container part 221 via the leg part 224. The main body part 225, the leg part 224, and the handle part 223, which are continuous, constitute the ink container part 221 having a bag shape. Therefore, in the ink container part 221, ink can be housed not only in the main body part 225 but also in the handle part 223 and the leg part 224.

Since the ink outlet unit 213 and the electrical contact unit 214 have the same configurations as in Embodiment 2, the detailed description thereof is omitted. In the ink container 50C, the ink outlet unit 213 and the electrical contact unit 214 are provided on the handle part 223. Ink inside the ink container part 211 reaches the ink outlet part 101 via the leg part 224 and the handle part 223. In the ink container 50C as well, the ink outlet unit 213 and the electrical contact unit 214 are provided on the same side of the ink container part 221. Also, in the ink container 50C as well, the ink outlet unit 213 and the electrical contact unit 214 are arranged along the K2 direction. Since an attachment method for attaching the ink container 50C to the attachment/detachment unit 171 is the same as that in Embodiment 2, the detailed description thereof is omitted.

The ink container 50C in Embodiment 3 achieves an effect that is the same as the effect of Embodiment 1. Furthermore, according to Embodiment 3, the handle part 223 is configured as a part of the ink container part 221, and accordingly the number of constituent parts can be smaller than that of Embodiment 1.

What is claimed is:

1. A liquid container that is attachable to and detachable from a liquid supply apparatus that supplies ink as a liquid to a liquid injection apparatus, the liquid container comprising:

a liquid container part that houses the ink;

a handle part that is located at an end of the liquid container part; and a liquid outlet part that is provided on the handle part and that is in communication with an inside of the liquid container part via the handle part, the handle part including a base part that is located at an end of the liquid container part and projects further outside than the liquid container part, a gripping part that is located further on the opposite side to the liquid container part side than the base part, and a leg part that connects the base part and the gripping part, and the liquid outlet part being provided on the gripping part.

2. The liquid container according to claim 1, wherein at least part of a flow channel that extends from the liquid container part and that is in communication with the liquid outlet part is provided in the leg part.

3. The liquid container according to claim 2, further comprising a flow channel member that constitutes at least part of the flow channel, wherein at least part of the flow channel member is housed in the leg part.

4. The liquid container according to claim 1, wherein a liquid outlet port is formed in the liquid outlet part, and when the liquid container is supported by gripping the handle part, the liquid outlet port is orientated in a direction that intersects a direction of gravity.

5. The liquid container according to claim 1, further comprising an electrical contact part that is contactable with an electrical connection part provided in the liquid supply apparatus, wherein the electrical contact part is provided on the handle part.

6. The liquid container according to claim 1, wherein the liquid container is configured to be attachable to and detachable from the liquid supply apparatus that supplies the ink to the liquid injection apparatus.

7. A liquid container that is attachable to and detachable from a liquid supply apparatus that supplies ink as a liquid to a liquid injection apparatus, the liquid container comprising:

a liquid container part that houses the ink;

a liquid outlet part that is in communication with an inside of the liquid container part; and an electrical contact part that is contactable with an electrical connection part provided in the liquid supply apparatus, a handle part being formed at an end of the liquid container part, and the liquid outlet part and the electrical contact part being provided on the handle part.

8. The liquid container according to claim 7, wherein the liquid container is configured to be attachable to and detachable from the liquid supply apparatus that supplies the ink to the liquid injection apparatus.

9. The liquid container according to claim 7, wherein the handle part includes a gripping part configured to hold the liquid container by gripping the gripping part, and the liquid outlet part is provided on the gripping part.

10. A liquid supply apparatus to which a liquid container that houses a liquid is to be detachably attached, and that is capable of supplying the liquid housed in the liquid container to a liquid injection apparatus, wherein the liquid container includes: a liquid container part that is capable of housing the liquid; a handle part that is located at an end of the liquid container part; and a liquid outlet part that is provided on the handle part and that is in communication with an inside of the liquid container part via the handle part, the liquid outlet part is located on a portion of the handle part that is on an opposite side to the liquid container part side, the liquid supply apparatus includes: a liquid inlet part to which the liquid inside the liquid container part is supplied from the liquid outlet part; and a movable supporting part that supports the handle part so as to be attachable and detachable, the handle part includes a first engaging part that is engageable with the movable supporting part, a first engaged part with which the first engaging part of the handle part engages is formed in the movable supporting part, and in a state where the first engaging part of the handle part engages with the first engaged part, the movable supporting part is displaceable from a release position to a connected position, the release position being a position in which the liquid outlet part and the liquid inlet part are spaced apart from each other, and the connected position being a position in which the liquid outlet part and the liquid inlet part are connected to each other.

* * * * *